US012577704B2

(12) United States Patent
Abe et al.

(10) Patent No.: US 12,577,704 B2
(45) Date of Patent: Mar. 17, 2026

(54) FIBER SHEET, ELECTROSPINNING DEVICE, AND METHOD FOR MANUFACTURING FIBER SHEET

(71) Applicant: Kao Corporation, Tokyo (JP)

(72) Inventors: Yuta Abe, Utsunomiya (JP); Takatoshi Niitsu, Utsunomiya (JP); Takehiko Tojo, Utsunomiya (JP)

(73) Assignee: KAO CORPORATION, Tokyo (JP)

( * ) Notice: Subject to any disclaimer, the term of this patent is extended or adjusted under 35 U.S.C. 154(b) by 479 days.

(21) Appl. No.: 18/011,213

(22) PCT Filed: Jun. 14, 2021

(86) PCT No.: PCT/JP2021/022596
§ 371 (c)(1),
(2) Date: Dec. 19, 2022

(87) PCT Pub. No.: WO2021/256445
PCT Pub. Date: Dec. 23, 2021

(65) Prior Publication Data

US 2023/0228001 A1 Jul. 20, 2023

(30) Foreign Application Priority Data

Jun. 19, 2020 (JP) ..... 2020-106182

(51) Int. Cl.
*D01D 5/00* (2006.01)
*D01D 5/14* (2006.01)
(Continued)

(52) U.S. Cl.
CPC ..... *D01D 5/0092* (2013.01); *D01D 5/0023* (2013.01); *D01D 5/0038* (2013.01);
(Continued)

(58) Field of Classification Search
CPC .. D01D 5/0092; D01D 5/0023; D01D 5/0038; D01D 5/14; D04H 1/43835; D04H 1/4291; D04H 1/728; D04H 1/732
(Continued)

(56) References Cited

U.S. PATENT DOCUMENTS 7,390,760 B1 6/2008 Chen et al.
2002/0182333 A1 12/2002 Seaver et al.
(Continued)

FOREIGN PATENT DOCUMENTS

CN 1766181 A 5/2006
CN 101671853 A 3/2010
(Continued)

OTHER PUBLICATIONS

JP-2004238749-A machine translation (Year: 2004).*
(Continued)

*Primary Examiner* — Vincent Tatesure
(74) *Attorney, Agent, or Firm* — XSENSUS LLP

(57) ABSTRACT

An electrospinning device includes: a plurality of nozzles that discharge a spinning solution containing a resin; and a plurality of power sources for applying charge to the solution. The power sources are connected such that different charges are applied to the solutions discharged from the nozzles, respectively. The fiber sheet is a long fiber nonwoven fabric including first fibers and second fibers that are different from the first fibers. In a histogram based on fiber diameter distributions and frequencies of the numbers of fibers, the fiber sheet has a peak where a ratio P1 of a frequency of the number of fibers of the first fibers to a frequency of the number of fibers of the second fibers is 0.01 or more and 100 or less. Alternatively, the fiber sheet has two or more peaks in the histogram, in which a ratio P2 of a frequency of the number of fibers of the first fibers at a
(Continued)

highest peak in a range of a fiber diameter of 3 μm or less to a frequency of the number of fibers of the second fibers at a highest peak in a range of a fiber diameter of more than 3 μm is 1 or more and 1 000 or less.

20 Claims, 7 Drawing Sheets

(51) Int. Cl.
*D04H 1/4291* (2012.01)
*D04H 1/4382* (2012.01)
*D04H 1/728* (2012.01)
*D04H 1/732* (2012.01)

(52) U.S. Cl.
CPC ..... *D01D 5/14* (2013.01); *D04H 1/4291* (2013.01); *D04H 1/43835* (2020.05); *D04H 1/728* (2013.01); *D04H 1/732* (2013.01); *D10B 2321/022* (2013.01)

(58) Field of Classification Search
USPC ..... 442/351
See application file for complete search history.

(56) References Cited

U.S. PATENT DOCUMENTS

| | | | |
|---|---|---|---|
| 2008/0160856 | A1 | 7/2008 | Chen et al. |
| 2015/0275399 | A1 | 10/2015 | Kodama |
| 2016/0074790 | A1 | 3/2016 | Kuroda et al. |
| 2016/0361270 | A1 | 12/2016 | Stoddard et al. |
| 2017/0233911 | A1 | 8/2017 | Wang et al. |
| 2019/0127885 | A1 | 5/2019 | Amari et al. |
| 2019/0153641 | A2 | 5/2019 | Wang et al. |
| 2020/0354869 | A1 | 11/2020 | Wang et al. |

FOREIGN PATENT DOCUMENTS

| | | | | | |
|---|---|---|---|---|---|
| CN | 102121137 | A | | 7/2011 | |
| CN | 106661789 | A | | 5/2017 | |
| CN | 108866650 | A | | 11/2018 | |
| CN | 110167372 | A | | 8/2019 | |
| EP | 3786322 | A1 | * | 3/2021 | ..... D01D 5/0076 |
| JP | 2004238749 | A | * | 8/2004 | |
| JP | 2005-171408 | A | | 6/2005 | |
| JP | 2008-144327 | A | | 6/2008 | |
| JP | 2009-57655 | A | | 3/2009 | |
| JP | 4354703 | B2 | | 10/2009 | |
| JP | 4809203 | B2 | | 11/2011 | |
| JP | 2012-1865 | A | | 1/2012 | |
| JP | 5719421 | B2 | | 5/2015 | |
| JP | 2017-31517 | A | | 2/2017 | |
| JP | 2018-193658 | A | | 12/2018 | |
| JP | 2022-1688 | A | | 1/2022 | |
| KR | 1020070073851 | A | | 7/2007 | |
| WO | 2008/038536 | A1 | | 4/2008 | |
| WO | 2018/162950 | A1 | | 9/2018 | |

OTHER PUBLICATIONS

Extended European search report issued on May 31, 2024, in corresponding European patent Application No. 21824276.6, 11 pages.
International Search Report and Written Opinion mailed on Aug. 31, 2021, received for PCT Application PCT/JP2021/022596, filed on Jun. 14, 2021, 15 pages including English Translation.

* cited by examiner

FIBER SHEET, ELECTROSPINNING DEVICE, AND METHOD FOR MANUFACTURING FIBER SHEET

CROSS-REFERENCE TO RELATED APPLICATIONS

The present application is a 371 of PCT filing PCT/JP2021/022596, filed Jun. 14, 2021, which claims the priority to Japanese Patent Application No. 2020-106182, filed on Jun. 19, 2020, wherein the entire contents of each are incorporated herein by reference.

TECHNICAL FIELD

The present invention relates to a fiber sheet, an electrospinning device, and a method of producing a fiber sheet.

BACKGROUND ART

An electrospinning method is a technique of applying a high voltage to a solution or a melt (hereinafter, both of which will also be referred to as the spinning solution) of a resin as a raw material of fibers to simply produce a fiber sheet including fibers with a nano-size diameter with high productivity.

The present applicant proposed an electrospinning device in which, in a state where an electric field is generated between an electrode having a concave curved surface and a nozzle disposed to be surrounded by the concave curved surface, nanofibers are formed from a spinning solution discharged from a tip end of the nozzle (Patent Literature 1). In addition, the same literature discloses that the formed nanofibers are randomly deposited to obtain a nanofiber sheet.

In addition, the present applicant proposed a method of producing ultrafine fibers, the method including electrospinning fibers using a mixture that includes a resin having a melting point and an additive such as an alkyl sulfonate (Patent Literature 2). In this production method, ultrafine fibers can be electrospun by stably charging the raw resin.

Regarding the fiber sheet and the production method thereof, Patent Literature 3 discloses ultrafine fiber nonwoven fabric in which electrostatically spun fibers formed by an electrostatic spinning method and melt-blown fibers formed by a melt blowing method are mixed and ultrafine fibers having a fiber diameter of 0.001 to 1 μm and fine fibers having a fiber diameter of 2 to 25 μm are mixed.

In addition, Patent Literature 4 discloses mixed fiber nonwoven fabric including fiber groups that includes at least two kinds of polyolefin-based resin components. In this nonwoven fabric, a number average fiber diameter of fibers formed of one resin component is 0.3 to 7.0 μm, fiber diameters of fibers formed of another resin component are 5 times or more the number average fiber diameter, and each of the fiber diameters of the fibers formed of the other resin component is 15 to 100 μm.

Regarding a production device used for the electrospinning method, Patent Literature 5 discloses a nonwoven fabric production device where a plurality of electrodes used for electrospinning are disposed. The same literature discloses that a plurality of electrodes and voltage change means capable of periodically changing voltage application to each of the electrodes are connected to the production device, and the voltage change means causes the electrode to generate a variable electric field to control the thickness of the nonwoven fabric.

CITATION LIST

Patent Literature

Patent Literature 1: US 2015/0275399A1
Patent Literature 2: US 2019/0127885A1
Patent Literature 3: JP2009-57655A
Patent Literature 4: US 2016/0074790A1
Patent Literature 5: JP2008-144327A

SUMMARY OF INVENTION

The present invention relates to an electrospinning device.

It is preferable that the electrospinning device includes: a plurality of nozzles that discharge a spinning solution including a resin; and a plurality of power sources for applying charge to the spinning solution.

In the electrospinning device, it is preferable that the power sources are connected such that different charges are applied to the spinning solutions discharged from the nozzles, respectively.

In addition, the present invention relates to a method of producing a fiber sheet using the above-described electrospinning device.

Further, the present invention relates to a fiber sheet.

It is preferable that the fiber sheet includes a long fiber nonwoven fabric including first fibers that are long fibers and second fibers that are long fibers and are different from the first fibers.

It is preferable that, in a histogram based on fiber diameter distributions and frequencies of the numbers of fibers in the fiber sheet, a peak of a fiber diameter distribution including the first fibers and the second fibers is shown.

In the fiber sheet, it is preferable that a ratio P1 (first fibers/second fibers) of a frequency of the number of fibers of the first fibers to a frequency of the number of fibers of the second fibers is 0.01 or more and 100 or less at a position of a fiber diameter where the peak is shown.

In addition or alternatively, in the fiber sheet, it is preferable that two or more peaks of fiber diameter distributions are shown.

In the fiber sheet, it is preferable that a ratio P2 (3 μm or less/more than 3 μm) of a frequency of the number of fibers of the first fibers at a highest peak in a range of a fiber diameter of 3 μm or less to a frequency of the number of fibers of the second fibers at a highest peak in a range of a fiber diameter of more than 3 μm is 1 or more and 1000 or less.

Other characteristics of the present invention will be clarified from the claims and the following description.

DESCRIPTION OF EMBODIMENTS

Figure 1:
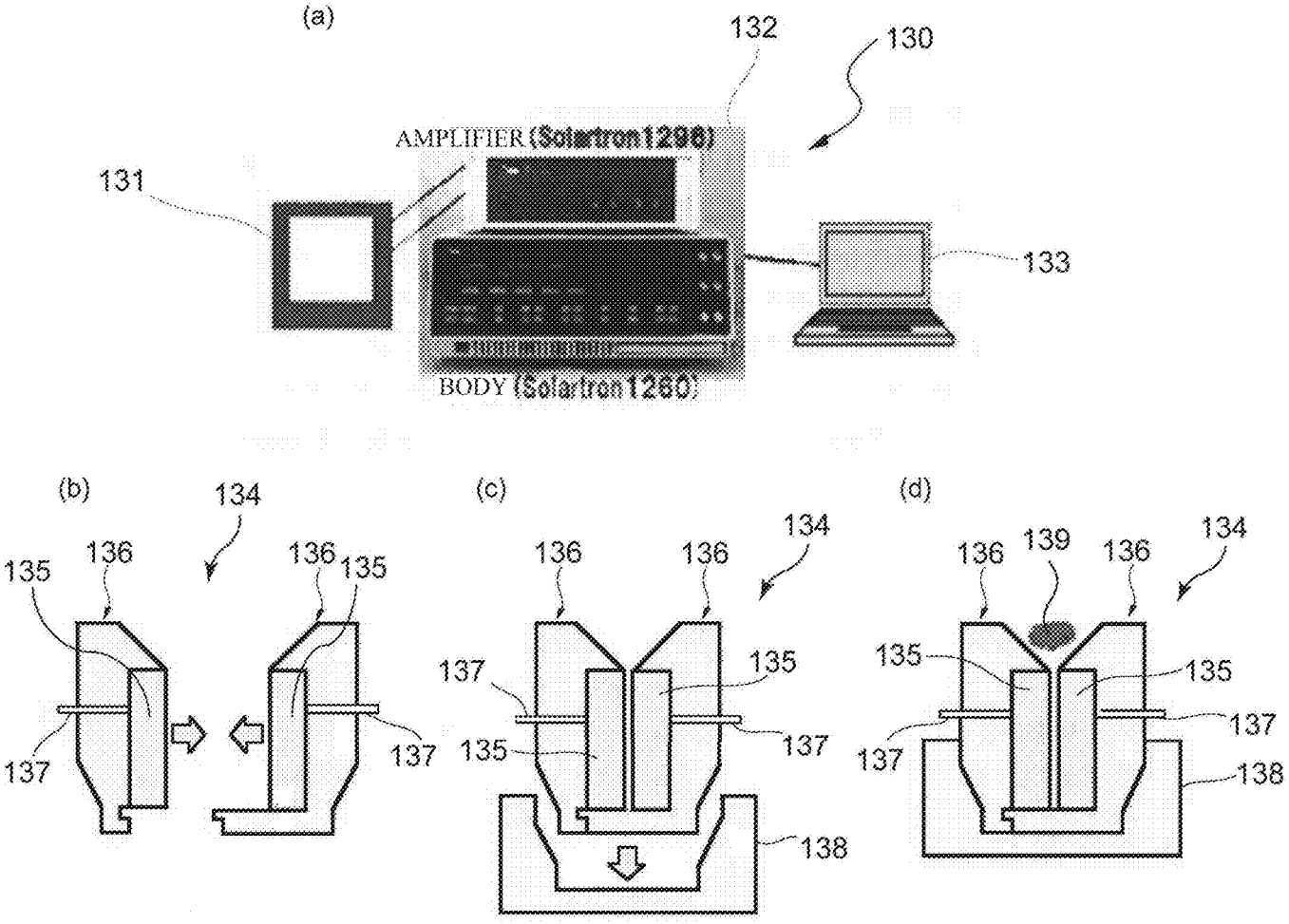
FIGS. 1(*a*) to (*d*) are schematic diagrams illustrating a method of measuring an absolute value of an electric impedance.

From the viewpoint of improving the production efficiency of ultrafine fibers and a sheet including the fibers, in a state where a plurality of discharge nozzles is disposed in one direction, a spinning solution is discharged to produce a fiber sheet. In this case, depending on the distance of the discharge nozzles, the discharge flow rate of the spinning solution, and the like, portions where the amount of produced fibers deposited is large and portions where the amount of produced fibers deposited is small are formed, and thus a fiber sheet where basis weight unevenness occurs may be produced. In addition, in a case where an electrospinning method is used for producing a fiber sheet, when fibers are electrospun in a state where voltages having the same polarity are applied to discharge nozzles or in a state where discharge nozzles to which a voltage is applied and discharge nozzles to which a voltage is not applied are alternately disposed, electric repulsion is likely to occur between spinning solutions discharged from adjacent nozzles or between electrospun fibers. As a result, fibers are deposited such that portions where the amount of produced fibers deposited is large and portions where the amount of produced fibers deposited is small are present, and a fiber sheet where unevenness of a basis weight distribution occurs is produced. Uniformity of the basis weight distribution is not considered by any of the techniques of Patent Literatures 1 to 5, and there is a room for improvement from the viewpoint of producing a fiber sheet having a uniform basis weight in a width direction.

In addition, regarding all of the fiber sheets described in Patent Literatures 1 to 5, when nanofibers having different fiber diameters are spun from adjacent nozzles or when different kinds of nanofibers are spun, it is difficult to obtain a fiber sheet having a uniform structure due to the electric repulsion, and a fiber sheet in a state where plural kinds of fibers are mixed cannot be obtained.

Accordingly, the present invention relates to a device and a method capable of producing a fiber sheet having a uniform basis weight distribution, and a fiber sheet including plural kinds of fibers in a mixed state.

Hereinafter, the present invention will be described based on a preferable embodiment.

In this description, when an upper limit value, a lower limit value, or upper and lower limit values of numerical values are defined, the upper limit value and the lower limit value themselves are also included. In addition, even if not explicitly specified, all of the numerical values or numerical ranges within a range of the upper limit value or less, the lower limit value or more, or the upper and lower limit values are construed to be described.

In this description, "a", "an", and the like are construed as one or more.

It should be understood that various modifications and alterations can be made to the present invention based on the foregoing disclosure and the following disclosure in this description. Accordingly, it should be understood that the present invention can also be implemented in an embodiment that is not clearly stated in this description, within the technical scope based on the claims.

The entire contents of Patent Literatures above and the following patent literatures are incorporated herein as a part of the content of this specification.

The present application claims the priority based on Japanese Patent Application No. 2020-106182 filed on Jun. 19, 2020, and the entire content of Japanese Patent Application No. 2020-106182 is incorporated herein as a part of this description.

A fiber sheet according to the present disclosure typically includes long fibers and is an entangled fiber aggregate formed by the long fibers. This entangled fiber aggregate is preferably long fiber nonwoven fabric.

By forming the fiber sheet with long fibers, the long fibers are entangled with each other to prevent fiber shedding from the sheet and to maintain the sheet strength.

The present disclosure relates to a method of producing a fiber sheet using an electrospinning device. In addition, the fiber sheet according to the present disclosure is preferably produced using a melt blowing method or an electrospinning method and is more preferably produced using an electrospinning method. That is, the fiber sheet is preferably melt-blown nonwoven fabric or electrospun nonwoven fabric and is more preferably electrospun nonwoven fabric.

Electrospinning is a method of discharging a solution or a melt including a resin as a raw material of fibers into an electric field in a state where a high voltage is applied such that the discharged liquid can be finely drawn to form ultrafine fibers.

By adopting the electrospinning method as a suitable production method for a fiber sheet, fibers having a longer fiber length is likely to be obtained, and a sheet having less number of fused points between fibers is likely to be obtained as compared to the melt blowing method. As a result, long fibers are entangled such that fiber shedding from the sheet can be prevented and the degree of freedom for the movement of fibers increases. Therefore, bulkiness or a high pore volume is likely to be exhibited. As a result, a sheet having excellent air permeability and excellent texture can be obtained.

The long fiber in the fiber sheet according to the present disclosure is a continuous fiber having a fiber length of 10 cm or more.

The fiber length is measured, for example, using a method of taking out any one fiber from an entangled fiber aggregate using tweezers or the like and measuring the length of the taken fiber with a scale or the like or a method of dividing a range of a fiber length of 10 cm or more on the entangled fiber aggregate into a plurality of regions, imaging the regions with a scanning electron microscope (SEM) or a digital microscope, synthesizing and combining these images to generate a wide field-of view high-resolution image, and tracing the length of one fiber.

The structure of the fiber sheet according to the present disclosure is formed without using fibers other than long fibers, but it is allowable for the fiber sheet to unavoidably include fibers other than long fibers.

When the fiber sheet unavoidably includes fibers other than long fibers, the content thereof in the fiber sheet in terms of number with respect to 100 or more constituent fibers as a measurement target is preferably 0% or more and 10% or less, more preferably 5% or less, and still more preferably 0%.

In the fiber sheet that is obtained using the electrospinning device according to the present disclosure and the method of producing a fiber sheet using the electrospinning device, it is preferable that the basis weight is uniform. In the present disclosure, "the basis weight being uniform" represents that a variation of the basis weight is ±10% or less when measured using a measurement method based on the following method of measuring a basis weight.

[Method of Measuring Basis Weight]

When a fiber sheet to be measured is in a roll form, the fiber sheet is divided into 15 points or more in a width direction; and when a fiber sheet to be measured is in a sheet form, the entirety of the fiber sheet is divided into 15 points or more. Center portions of the divided points are cut as measurement samples.

Next, the cut fiber sheet is left to stand in a natural state where an external force is not applied thereto. The fiber sheet is cut into a predetermined area (for example, 2 cm×2 cm) using a single-edge razor blade (model name: FAS-10, manufactured by FEATHER Safety Razor Co., Ltd.). Next, the mass of the fiber sheet cut in the predetermined area is measured, and the mass is divided by the area.

This is performed on the 15 measurement samples, and a variation (%) is obtained from the following Expression (a).

$$\text{Variation (\%)} = (\text{Standard Deviation of Measurement samples}/\text{Average Value of Measurement samples}) \times 100 \qquad \text{Expression (a)}$$

The fiber sheet according to the present disclosure can be distinguished into, for example, the following aspects depending on the kinds and fiber diameter distributions of fibers in the sheet. All of the fiber sheets according to these aspects are included in the present disclosure.

(A) A fiber sheet includes a first fiber group including first fibers that are long fibers and a second fiber group including second fibers that are long fibers, in which at least two peaks of fiber diameter distributions are shown. In this aspect, it is determined that the first fibers and the second fibers have different fiber diameter distributions such that the kinds of the fibers are different from each other.

(B) A fiber sheet includes a first fiber group including first fibers that are long fibers and a second fiber group including second fibers that are long fibers, in which at least one peaks of a fiber diameter distribution is shown. In this aspect, the first fibers and the second fibers are different in the kind of the fibers except for the fiber diameter distribution.

(C) A fiber sheet that is formed of only one kind of long fibers.

The kind of fibers refers to at least one of a fiber diameter distribution, the kind and content of a resin as a constituent component of the fibers, or the kind and content of an additive.

That is, when the long fibers forming the fiber sheet are compared to each other, at least either of fiber diameter distributions of the fibers, the kinds and contents of constituent resins of the fibers, or the kinds and contents of additives being different will be referred to as "the kinds of the fibers being different", and all of fiber diameter distributions of the fibers, the kinds and contents of constituent resins of the fibers, or the kinds and contents of additives being the same will be referred to as "the kinds of the fibers being the same".

In addition, in the present disclosure, when the resin in the constituent fiber is analyzed, chemical structures (including skeletons and functional groups) of the resins being different or average molecular weights thereof being different will be referred to as "the kinds of the resins being different" or "the resins having different kinds", and chemical structures (including skeletons and functional groups) of the resins being the same and average molecular weights thereof being the same will be referred to as "the kinds of the resins being the same" or "the resins having the same kind".

From the viewpoint of exhibiting desired characteristics derived from fibers having different fiber diameter distributions or fibers having different kinds and achieving the uniformity of the basis weight at the same time, it is preferable that the fiber sheet according to the present disclosure is the aspect (A) or (B) described above.

Examples of the desired characteristics include hydrophilicity and hydrophobicity, but the present disclosure is not limited thereto.

In either case where the fiber sheet according to the present disclosure is the above-described aspect (A), (B), or (C), when a histogram based on fiber diameter distributions and frequencies of the numbers of fibers is generated, peaks of fiber diameter distributions are shown. "Peak" refers to the apex of a peak represented by the histogram.

One or two or more peaks of fiber diameter distributions are observed, and it is preferable that only one peak is observed or only two peaks are observed.

It is preferable that at least one peak of a fiber diameter distribution is shown at a position where the fiber diameter is less than 3 μm.

A configuration of the fiber sheet having this peak of the fiber diameter distribution and a method of producing the same will be described below.

The peak of the fiber diameter distribution in the fiber sheet can be derived by generating a histogram based on frequencies of the numbers of fibers and the distribution of fiber diameters.

First, fiber diameters and the number of fibers for obtaining a peak position of a fiber diameter distribution are measured. In order to obtain the fiber diameters and the number of fibers, fibers in the entire fiber sheet are observed, for example, at 2 000-fold magnification with SEM observation, and a two-dimensional image thereof is derived. The number of fibers is measured by counting a continuous fiber in the range of the obtained two-dimensional image as one fiber. In the measurement of the fiber diameter, in a rectangular two-dimensional image obtained by SEM observation, a virtual diagonal line is drawn, and a fiber diameter at a position where the virtual diagonal line and a fiber intersect each other is measured as a target. In this case, when a line perpendicular to a longitudinal direction of a fiber excluding defects such as a lump of fibers, an intersection portion of fibers, or a polymer liquid droplet is drawn, a read value of the maximum diameter length is obtained as a fiber diameter. In this measurement, the observation is repeated while changing the position of the SEM observation until the number of fibers of which the fiber diameter is measured is 100 or more.

A peak of a fiber diameter distribution is calculated using the following method for the entire fiber sheet as a target. Regarding a peak of a fiber diameter distribution of long fibers, fiber diameters are measured using the above-described method, a histogram of a fiber diameter distribution is generated from a distribution of the number of fibers for each of the fiber diameters, and a position of a fiber diameter where a peak is shown is calculated.

In order to generate the histogram, the x axis represents a fiber diameter (μm) that is plotted on a logarithmic scale with a base of 10, and the y axis represents the percentage of a frequency. On the x axis, a range from a fiber diameter of 0.1 ($=10^{-1}$) μm to a fiber diameter of 50.1 ($=10^{1.7}$) μm is equally divided into 27 sections on the logarithmic scale to generate a histogram. A representative fiber diameter in one divided section is a geometric mean value between a minimum value and a maximum value of the x axis in the divided section.

Whether or not two or more fiber groups having different compositions of constituent fibers are present in the fiber sheet is determined by performing micro IR, SEM-EDX, and XPS analysis on the entire fiber sheet as a measurement target and measuring whether or not a constituent element is present or whether or not the kind or chemical structure of a constituent resin is included.

In detail, the determination is made using the following method. First, for the fiber sheet as a measurement target, fibers are observed at 2 000-fold magnification using, for example, a SEM or an atomic force microscope (AFM), and element mapping analysis or mapping analysis of various physical properties is performed. The kinds of fibers forming the fiber sheet are distinguished from each other based on the obtained mapping analysis result.

Regarding the state of mapping obtained by the above-described analysis, when fibers including a specific element and fibers not including the specific element are present, it is verified that the mapping state by a specific element varies depending on fibers, or it is verified that fibers having different adsorption forces between a probe and the fibers measured in the AFM observation or fibers having different hardness values are present, it is determined that the kinds of the fibers are different. On the other hand, regarding the state of mapping when fibers as a measurement target have the same element at the same proportion and it is verified that fibers having the same adsorption force between a probe and the fibers measured in the AFM observation or fibers having same hardness are present, it is determined that the kinds of the fibers are the same.

In a case where it is determined that the kinds of fibers are different in the mapping analysis, when an aggregate of fibers that are formed as the same kind is set as one fiber group, it is determined a plurality of fiber groups is present in the fiber sheet.

Whether or not each of the fiber groups is present and the fiber diameter where a peak position of a fiber diameter distribution of each of the fiber groups is shown can be determined and calculated, for example, with an elemental mapping analysis image using a SEM or with a mapping image of various physical properties using an AFM. For example, when a SEM is used, fibers forming the fiber sheet are observed at 2 000-fold magnification with a SEM, and element mapping analysis is performed on the obtained SEM image to distinguish between the first fiber group and the second fiber group based on elements in each of the fiber groups.

The fiber diameter is measured using the above-described method to generate a histogram, and the position of the fiber diameter where a peak of a fiber diameter distribution is shown is calculated from the fiber diameter distribution.

From the histogram obtained as described above, one peak of a fiber diameter distribution is observed or two or more peaks of fiber diameter distributions are observed by visual inspection.

When one peak of a fiber diameter distribution is observed, fiber diameters of the first fibers and the second fibers and distributions thereof are the same. Therefore, fibers having the fiber diameter at the peak position are classified by performing the above-described mapping analysis. When it is determined that the kinds of the fibers are different, one kind is assumed as the first fiber, another kind is assumed as the second fiber, and the frequency of the number of fibers of each of the kinds is calculated to calculate a ratio P1 between the frequencies of the fibers with respect to the height of the peak. This embodiment where the peak is observed and the ratio P1 is, for example a value described below is typically included in the above-described aspect (B).

When two or more peaks of fiber diameter distributions are observed, fiber diameters of the first fibers and the second fibers and distributions thereof are different from each other. In the histogram, a peak having the maximum height in a range of a fiber diameter of 3 μm or less is assumed as a peak derived from the first fibers, and a peak having the maximum height in a range of a fiber diameter of more than 3 μm is assumed as a peak derived from the second fibers. A ratio P2 between the frequencies of the number of the fibers is calculated based on the heights of the peaks. This embodiment where the peaks are observed as described above is typically included in the above-described aspect (A).

The details of the ratios P1 and P2 between the frequencies will be described below.

When it is determined that the kinds of the fibers are the same in the mapping analysis and only one peak of a fiber diameter distribution derived using the above-described method is present, one fiber group forming the fiber sheet is present. In this case, the aspect is the fiber sheet according to the aspect C.

In the fiber sheet according to the present disclosure, when attention is paid to the peak of the fiber diameter distribution represented by the above-described histogram, it is preferable that the frequency of the number of fibers of the first fibers and the frequency of the number of fibers of the second fibers are at a predetermined ratio at the position of the fiber diameter where the peak is shown.

Specifically, when only one peak of a fiber diameter distribution represented by the histogram is observed, the ratio P1 (fiber diameters/second fibers) of the frequency of the number of fibers of the first fibers to the frequency of the number of fibers of the second fibers at the position of the fiber diameter where the peak is shown is preferably 0.01 or more, more preferably 0.1 or more, and still more preferably 0.5 or more.

In addition, the ratio P1 is preferably 100 or less, more preferably 80 or less, and still more preferably 50 or less.

The ratio P1 between the frequencies shows the degree to which the fibers are mixed in the fiber sheet. Accordingly, by adjusting the ratio P1 to be in the above-described range, both of physical properties derived from the first fibers and the second fibers are likely to be uniformly exhibited, and a fiber sheet having desired physical properties can be efficiently obtained.

When two or more peaks of fiber diameter distributions represented by the histogram are observed, the ratio P2 (3 μm or less/more than 3 μm) of the frequency of the number of fibers of the first fibers at the peak derived from the first fiber to the frequency of the number of fibers of the second fibers at the peak derived from the second fiber is preferably 1 or more, more preferably 2 or more, even more preferably 3 or more, and still more preferably 5 or more and is preferably 1000 or less, more preferably 800 or less, even more preferably 600 or less, and still more preferably 400 or less.

The ratio P2 between the frequencies shows the degree to which the fibers are mixed in the fiber sheet as in the ratio P1. Accordingly, by adjusting the ratio P2 to be in the above-described range, both of physical properties (for example, a capillary force) derived from the fiber diameter of the first fibers and physical properties (for example, a fiber strength) derived from the fiber diameter of the second fibers can be effectively and uniformly exhibited, and a fiber sheet having desired physical properties can be efficiently obtained.

The ratio P1 between the frequencies only has to satisfy the above-described range on at least one of one surface and another surface of the fiber sheet, and from the viewpoint of allowing the constituent fibers of the sheet to be uniformly present in the sheet, it is preferable that the ratio P1 between the frequencies is satisfied on both of one surface and another surface of the fiber sheet.

Likewise, the ratio P2 between the frequencies only has to satisfy the above-described range on at least one of one surface and another surface of the fiber sheet, and from the viewpoint of allowing the constituent fibers of the sheet to be uniformly present in the sheet, it is preferable that the ratio P2 between the frequencies is satisfied on both of one surface and another surface of the fiber sheet.

The uniformity of the fiber sheet can be measured with the following method using the above-described ratio P1 or ratio P2 between the frequencies.

Regarding the fiber sheet as a measurement target, one surface and another surface of a center portion of a sheet piece are provided to the measurement of the fiber diameter and the generation of the histogram described above.

For example, when the average fiber diameters of the fibers are different from each other as in the fiber sheet according to the aspect (A), one surface and another surface at any point of a center portion of each of sheet pieces are used as measurement points. On one surface, the ratio P2 (3 μm or less/more than 3 μm) of a frequency of the number of fibers of the first fibers at a highest peak in a range of a fiber diameter of 3 μm or less to a frequency of the number of fibers of the second fibers at a highest peak in a range of a fiber diameter of more than 3 μm is represented by P2a. Likewise, on another surface, the ratio P2 (3 mm or less/more than 3 mm) is represented by P2b. An arithmetic mean value La of P2a and P2b is calculated. At this time, when a numerical range of the arithmetic mean value La×0.8 or more and the arithmetic mean value La×1.2 or less (a range of ±20% of the arithmetic mean value La) includes at least one of the ratios P2a and P2b obtained from each of the sheet pieces, it is assumed that the fibers are uniformly mixed in the fiber sheet, and when the numerical range includes both of P2a and P2b, it is assumed that the fibers are more uniformly mixed in the fiber sheet. When both of the ratios P2a and P2b are not included in the range of ±20% of the arithmetic mean value La, the fibers in the fiber sheet as a measurement target are not uniformly mixed.

For example, as in the fiber sheet according to the aspect (B), when it is determined that the average fiber diameters of the fibers are the same and it is determined that the kinds of the fibers are different by the above-described mapping analysis, the ratio P1 (fiber diameters/second fibers) of the frequency of the number of fibers of the first fibers to the frequency of the number of fibers of the second fibers at a peak of a fiber diameter distribution including the first fibers and the second fibers is calculated. Furthermore, an arithmetic mean value Ha of the ratios P1 obtained from the sheet pieces is calculated. At this time, when a numerical range of the arithmetic mean value Ha×0.8 or more and the arithmetic mean value Ha×1.2 or less (a range of ±20% of the arithmetic mean value Ha) includes the ratio P1 obtained at least one surface of each of the sheet pieces, it is assumed that the fibers in the fiber sheet are uniformly mixed. In addition, when both of the ratio P1 obtained from one surface and the ratio P1 obtained from another surface are included in the above-described numerical range, it is assumed that the fibers in the fiber sheet are more uniformly mixed. On the other hand, when both of the ratio P1 obtained from one surface and the ratio P1 obtained from another surface are not included in the above-described numerical range, it is assumed that the fibers in the fiber sheet are not uniformly mixed.

When the above-described ratio P1 is measured from one surface and another surface of the fiber sheet, from the viewpoint of obtaining the uniformity in a thickness direction of the sheet, a ratio (ratio P1 of one surface/ratio P1 of another surface) of the ratio P1 of the one surface of the fiber sheet to the ratio P1 of the other surface of the fiber sheet is preferably 0.6 or more, more preferably 0.7 or more, and even more preferably 0.8 or more and is preferably 1.5 or less, more preferably 1.4 or less, and even more preferably 1.3 or less.

In addition, when the above-described ratio P2 is measured from one surface and another surface of the fiber sheet, from the viewpoint of obtaining the uniformity in a thickness direction of the sheet, a ratio (P2a/P2b) of the ratio P2 (P2a) of the one surface of the fiber sheet to the ratio P2 (P2b) of the other surface of the fiber sheet is preferably 0.6 or more, more preferably 0.7 or more, and even more preferably 0.8 or more and is preferably 1.5 or less, more preferably 1.4 or less, and even more preferably 1.3 or less.

In either case where the fiber sheet according to the present disclosure is the above-described aspect (A), (B), or (C), it is preferable that an electric impedance of a resin melt in a uniform molten state obtained by melting the fiber sheet satisfies the following Expression (X).

$$A/B \geq 1.0\times10^2 \quad (X)$$

(In the expression, A represents an absolute value (Ω) of an electric impedance of the resin melt of the fiber sheet at 50° C., and B represents an absolute value (Ω) of an electric impedance of the resin melt of the fiber sheet at a temperature that is 50° C. higher than a melting point of the resin).

A method of measuring each of the electric impedances will be described below.

Hereinafter, one embodiment of the fiber sheet according to the aspect (A) will be described.

It is preferable that the fiber sheet according to the embodiment includes a first fiber group that is formed of first fibers as long fibers and a second fiber group that is formed of second fibers as long fibers. It is preferable that the long fibers forming these fiber groups are present in a mixed state rather than a state where the long fibers are separated from each other in the entire layer.

In the fiber sheet according to the embodiment, it is preferable that a peak of a fiber diameter distribution is shown at a position of a predetermined fiber diameter or less in the entire sheet. Specifically, the fiber diameter is more preferably 3 μm or less.

In addition, in the fiber sheet according to the embodiment, it is preferable that a peak of a fiber diameter distribution is shown at a position of more than a predetermined fiber diameter in the entire sheet.

That is, it is preferable that the fiber sheet according to the embodiment is configured such that a peak of a fiber diameter distribution is shown at least two positions of fiber diameters.

Here, when a histogram based on fiber diameter distributions and frequencies of the numbers of fibers is generated, a position of a fiber diameter where a peak of a fiber diameter distribution is shown is a position of a fiber diameter where the highest frequency is shown among the frequencies of the number of fibers. In this aspect, a position of a fiber diameter where a peak of a fiber diameter distribution is shown is observed in each of a position of a predetermined fiber diameter or less and a range of more than a predetermined fiber diameter. A method of measuring a fiber diameter distribution will be described below.

In this aspect, it is determined that the first fibers and the second fibers have different peak positions having the highest frequencies in the fiber diameter distributions such that the kinds of the fibers are different from each other.

When at least two peaks of fiber diameter distributions are present in the fiber sheet according to the embodiment, from the viewpoint of improving the surface area of the fiber sheet or increasing the number of fibers even at the same weight, a position of a fiber diameter where a peak on the small diameter side is shown is preferably 3 μm or less and more preferably 1 μm or less.

In addition, in the fiber sheet according to the embodiment, from the viewpoint of improving the strength of the first fibers, a position of a fiber diameter where a peak on the small diameter side is shown is preferably 10 nm or more and more preferably 50 nm or more.

It is preferable that the position of the fiber diameter where the peak on the small diameter side is shown is preferably a position of a fiber diameter where a peak of a fiber diameter distribution of the first fibers is shown.

In the fiber sheet, the position of the fiber diameter where the peak on the small diameter side is shown can be controlled by appropriately adjusting conditions such as a nozzle diameter, the amount of a raw resin discharged, a voltage during electrospinning, and a flow rate and a wind speed of a gas flow for example, in an electrospinning device described below.

When at least two peaks of fiber diameter distributions are present in the fiber sheet according to the embodiment, from the viewpoint of improving the shape retention and the strength of the entire fiber sheet, a position of a fiber diameter where a peak on the large diameter side is shown is preferably more than 3 μm, more preferably 5 μm or more, even more preferably 10 μm or more, and still more preferably 20 μm or more.

In addition, when at least two peaks of fiber diameter distributions are present in the fiber sheet according to the embodiment, from the viewpoints of maintaining the flexibility of the entire fiber sheet and improving handleability, a position of a fiber diameter where a peak on the large diameter side is shown is preferably 200 μm or less and more preferably 100 μm or less.

It is preferable that the position of the fiber diameter where the peak on the large diameter side is shown is preferably a position of a fiber diameter where a peak of a fiber diameter distribution of the second fibers is shown.

In the fiber sheet, the fiber diameter where the peak on the large diameter side is shown can be controlled by appropriately adjusting conditions such as a nozzle diameter, the amount of a raw resin discharged, a voltage during electrospinning, and a flow rate and a wind speed of a gas flow for example, in a spinning device used in a melt blowing method or an electrospinning device described below.

It is presumed that the fiber sheet has two or more peaks of fiber diameter distributions such that fibers having a small fiber diameter and fibers having a large fiber diameter are mixed. Therefore, a higher strength of the fiber sheet can be exhibited due to the stiffness of the fibers having a large fiber diameter.

Whether or not two or more fiber groups having different compositions of constituent fibers are present in the fiber sheet is determined by performing micro IR, SEM-EDX, and XPS analysis on the entire fiber sheet as a measurement target and measuring whether or not a constituent element is present or whether or not the kind or chemical structure of a constituent resin is included.

In detail, the determination is made using the following method. First, for the fiber sheet as a measurement target, fibers are observed at 2 000-fold magnification using, for example, a SEM or an atomic force microscope (AFM), and element mapping analysis or mapping analysis of various physical properties is performed. The kinds of fibers forming the fiber sheet are distinguished from each other based on the obtained mapping analysis result.

Regarding the state of mapping obtained by the above-described analysis, when fibers including a specific element and fibers not including the specific element are present, it is verified that the mapping state by a specific element varies depending on fibers, or it is verified that fibers having different adsorption forces between a probe and the fibers measured in the AFM observation or fibers having different hardness values are present, it is determined that the kinds of the fibers are different. On the other hand, regarding the state of mapping when fibers as a measurement target have the same element at the same proportion and it is verified that fibers having the same adsorption force between a probe and the fibers measured in the AFM observation or fibers having same hardness are present, it is determined that the kinds of the fibers are the same.

In a case where it is determined that the kinds of fibers are different in the mapping analysis, when an aggregate of fibers that are formed as the same kind is set as one fiber group, it is determined a plurality of fiber groups are present in the fiber sheet.

In the fiber sheet according to any one of the aspects, it is preferable that the long fibers forming the first fiber group and the long fibers forming the second fiber group include a resin having a melting point and an additive.

It is preferable that any of the fibers are formed of fibers obtained by electrospinning.

The details of the resin having a melting point and the additive will be described below.

In the fiber sheet according to the embodiment, it is preferable that the long fibers forming the first fiber group satisfy a relationship of the following Expression (I). In addition, it is also preferable that the first fiber group is formed of fibers obtained by electrospinning.

In addition, when the long fibers forming the second fiber group include an additive, it is preferable that the long fibers forming the second fiber group satisfy a relationship of the following Expression (I). In addition, it is also preferable that the second fiber group is formed of fibers obtained by electrospinning.

That is, it is preferable that at least either of the first fibers as the long fibers forming the first fiber group and the second fibers as the long fibers forming the second fiber group satisfy a relationship of the following Expression (I).

$$A/B \geq 1.0\times10^2 \quad (I)$$

(In the expression, A represents an absolute value (Ω) of an electric impedance of the resin at 50° C., and B represents an absolute value (Ω) of an electric impedance of the resin at a temperature that is 50° C. higher than a melting point of the resin)

A method of measuring each of the electric impedances will be described below.

In the fiber sheet according to any one of the aspects, when attention is paid to the long fibers forming the fiber sheet, it is preferable that the proportion of the number of long fibers having a fiber diameter of 3 μm or less that satisfy Expression (I) is in a predetermined range. Specifically, from the viewpoint of efficiently spinning fibers using an electrospinning method and easily including fine fibers in the fiber sheet, the proportion of the number of long fibers that satisfy Expression (I) is preferably 70% or more, more preferably 80% or more, and even more preferably 90% or more, and is realistically 100% or less. This proportion of the number of long fibers can be satisfied, for example, by obtaining the fibers forming the first fiber group by electrospinning and increasing the proportion of the number of the fibers in the first fiber group to be more than the proportion of the number of the fibers in another fiber group in the fiber sheet, or by obtaining the fibers forming the first fiber group and the second fiber group by electrospinning.

By the long fibers forming the first fiber group satisfying the relationship of Expression (I), even when a raw resin such as polypropylene having a high absolute value of an electric impedance in a solid state is used, the chargeability of a production raw material of the fibers is stably improved to be a physical property suitable for an electrospinning method, and the spinnability of the long fibers by an electrospinning method is improved. Furthermore, various kinds of resins can be used as raw materials, and ultrafine fibers can be produced.

Next, an embodiment of the fiber sheet according to the above-described aspect (B) will be described below.

The fiber sheet according to the embodiment includes: the first fiber group that is formed of long fibers; and the second fiber group that is formed of long fibers of which the kind is different from that of the first fiber group.

That is, in the fiber sheet according to the embodiment, the compositions of the constituent fibers are different such that the fiber sheet is configured to include at least two kinds of long fibers where the kinds are determined to be different. Here, the compositions of the constituent fibers being different represents that at least either of the kinds and contents of the resins as the constituent component of the fibers or the kinds and contents of the additives are different.

It is preferable that the long fibers forming these fiber groups are present in a mixed state rather than a state where the long fibers are separated from each other in the entire layer.

It is preferable that the fiber sheet according to the embodiment shows a peak of a fiber diameter distribution at a position where the fiber diameter is less than 3 μm.

It is preferable that the long fibers forming the first fiber group in the embodiment include a resin having a melting point and an additive.

It is also preferable that the first fiber group is formed of fibers obtained by electrospinning.

It is preferable that the long fibers forming the second fiber group in the embodiment are in any one of the following configurations (i) to (iii). That is, it is preferable that the compositions of the constituent fibers in the first fiber group and the second fiber group are different. It is also preferable that the second fiber group is formed of fibers obtained by electrospinning.

(i) The long fibers forming the second fiber group include a resin that is the same as the resin in the long fibers forming the first fiber group and an additive that is different from the additive in the long fibers forming the first fiber group.

(ii) The long fibers forming the second fiber group include a resin that is different from the resin in the long fibers forming the first fiber group and an additive that is the same as the additive in the long fibers forming the first fiber group.

(iii) The long fibers forming the second fiber group include a resin that is different from the resin in the long fibers forming the first fiber group and an additive that is different from the additive in the long fibers forming the first fiber group.

Here, regarding a criterion of whether or not the additives are different or the same, when the additives in the constituent fibers are analyzed, chemical structures (including skeletons and functional groups) of the additives being different or average molecular weights thereof being different is assumed as "the additives being different", and chemical structures (including skeletons and functional groups) of the additives being the same and average molecular weights thereof being the same is assumed as "the additives having the same kind".

In the aspect (B), a criterion of whether or not the resins are different or the same is whether or not the chemical structures (including skeletons and functional groups) of the resins are different or the same when the resins in the constituent fibers are analyzed.

In the fiber sheet according to the aspect (B), it is preferable that at least either of the first fibers as the long fibers forming the first fiber group and the second fibers as the long fibers forming the second fiber group satisfy a relationship of the following Expression (I).

In addition, it is preferable that both of the long fibers forming the first fiber group and the long fibers forming the second fiber group satisfy the following Expression (I).

This relational expression is the same as the above-described embodiment. A method of measuring each of the electric impedances will be described below.

$$A/B \geq 1.0\times10^2 \quad (I)$$

(In the expression, A represents an absolute value (Ω) of an electric impedance of the resin at 50° C., and B represents an absolute value (Ω) of an electric impedance of the resin at a temperature that is 50° C. higher than a melting point of the resin)

By each of the long fibers forming each of the fiber group satisfying the relationship of Expression (I), even when a raw resin such as polypropylene having a high absolute value of an electric impedance in a solid state is used, the chargeability of a production raw material of the fibers is stably improved to be a physical property suitable for an electrospinning method, and the spinnability of each of the long fibers by an electrospinning method is improved.

Furthermore, desired different physical properties for the fibers can be exhibited depending on the kinds of the additives in the fibers. Therefore, a fiber sheet in which fibers having different or contradictory physical properties are mixed and adjusted to have desired sheet physical properties or two or more functions can be exhibited with one sheet can be efficiently produced depending on the application of the fiber sheet.

Next, an embodiment of the fiber sheet according to the above-described aspect (C) will be described below.

The fiber sheet according to the above-described aspect (C) is formed of only one kind of long fibers.

It is preferable that the long fibers in the embodiment include a resin having a melting point and an additive.

In addition, in the embodiment, similarly, it is preferable that the long fibers satisfy the following Expression (I).

$$A/B \geq 1.0 \times 10^2 \quad (I)$$

(In the expression, A represents an absolute value (Ω) of an electric impedance of the resin at 50° C., and B represents an absolute value (Ω) of an electric impedance of the resin at a temperature that is 50° C. higher than a melting point of the resin)

Hereinafter, matters common to the fiber sheets according to the embodiments will be described.

The resin having a melting point refers to a resin having an endothermic peak caused by a phase change from solid to liquid before pyrolysis of the resin when the resin is heated.

"Melting point" refers to a temperature where a melting peak is observed in differential scanning calorimetry (DSC) and, when a plurality of peaks is observed, refers to a temperature having a highest endothermic peak. When a melting point of a component cannot be clearly measured using the above-described method, a softening point is used instead of the melting point.

In addition, from the viewpoint of successfully spinning fibers, the melting point of the resin is preferably 100° C. or higher and preferably 250° C. or lower.

It is preferable that the resin having a melting point that can be used in the present disclosure has fiber formability.

Specifically, examples of the resin having a melting point include various thermoplastic resins such as a polyolefin resin, a polyester resin, a polyamide resin, a vinyl-based polymer, an acrylic polymer, polycarbonate, polyamide imide, an aromatic polyether ketone resin, polyether imide, or a modified cellulose obtained by chemically modifying cellulose molecules.

Examples of the polyolefin resin include polyethylene, polypropylene, an ethylene-α-olefin copolymer, and an ethylene-propylene copolymer.

Examples of the polyester resin include polyethylene terephthalate, polybutylene terephthalate, a liquid crystal polymer, polyhydroxyalkanoate, polycaprolactone, polybutylene succinate, polyglycolic acid, and a polylactic acid-based resin.

Examples of the polylactic acid-based resin include polylactic acid and a lactic acid-hydroxy carboxylic acid copolymer.

Examples of the polyamide resin include nylon 6 and nylon 66.

Examples of the vinyl-based polymer include polyvinyl chloride, polyvinylidene chloride, polyvinyl acetate, a polyvinyl acetate-ethylene copolymer, and polystyrene.

Examples of the acrylic polymer include polyacrylic acid, a polyacrylic acid ester, polymethacrylic acid, and a polymethacrylic acid ester.

Examples of the aromatic polyether ketone resin include polyether ketone, polyether ether ketone, and polyether ether ketone ketone.

These resins can be used alone or in combination with two or more kinds.

The additive according to the present disclosure is a compound that is used together with the resin having a melting point and modifies the resin such that the chargeability of the resin is improved or hydrophilicity or hydrophobicity is exhibited on surfaces of the long fibers.

The hydrophilicity that is exhibited on the fibers refers to a property of increasing dispersibility of the fibers in water or an aqueous liquid and a property of improving the retention of water or an aqueous liquid between the fibers.

The hydrophobicity that is exhibited on the fibers refers to a property of decreasing dispersibility of the fibers in water or an aqueous liquid and a property of not retaining water or an aqueous liquid between the fibers or decreasing the retention, and includes the meaning of water repellency.

The hydrophilicity and the hydrophobicity of the fibers can be evaluated, for example, as a contact angle with water as an index.

It is preferable that the additive has a melting point at a temperature that is lower than or equal to the melting point of the resin to be used in combination from the viewpoint of increasing the dispersibility in the resin to efficiently modify the resin used for spinning. In order to adjust the melting point, it is also preferable to use two or more additives in combination as a mixture.

Examples of the additive include a charge control agent, an antioxidant, a neutralizer, a light stabilizer, an ultraviolet absorber, a lubricant, an antistatic agent, a metal deactivator, and a hydrophilizing agent. These additives can be used alone or in combination with two or more kinds.

In particular, from the viewpoint of efficiently forming long fibers having a small fiber diameter, as the additive, a charge control agent is preferably used, and various compounds having a salt structure are more preferably used.

From the viewpoint of easily performing ionization of the additive and improving the chargeability of the resin to be used in combination to more efficiently form continuous fibers, as the additive, a compound having a salt structure that is ionized during dissolution or melting is even more preferably used.

In addition, from the viewpoint of dispersibility in the resin, it is preferable that the additive is an organic salt, it is more preferable that the additive is a salt of an organic acid and an inorganic base, and it is more preferable that the additive is a salt of an organic acid and an inorganic base.

By using this salt, an absolute value of an electric impedance described below can be easily reduced, and a raw resin suitable for electrospinning can be effectively modified. In addition, when this resin is provided for electrospinning, continuous fibers can be easily formed.

As the additive, for example, a compound having a quaternary ammonium base structure or a metallic soap where a metal salt is formed can be suitably used.

In addition, as the additive, a compound having an alkyl group at a terminal of a structure and having a sulfonate group at any position in the structure (hereinafter, this compound will also be referred to as "alkyl sulfonate") can also be suitably used. By using the alkyl sulfonate as the additive, continuous fibers can be more easily formed.

Examples of the compound having a quaternary ammonium base structure include a styrene acrylic resin having a quaternary ammonium base structure.

As the styrene acrylic resin, a commercially available product can also be used. Examples of the commercially available product include ACRYBASE (registered trade name) FCA-201-PS and ACRYBASE (registered trade name) FCA-207P manufactured by Fujikura Kasei Co., Ltd.

Examples of the metallic soap include a divalent or higher fatty acid salt, specifically, a salt of a saturated or unsaturated fatty acid having 8 to 22 carbon atoms such as caprylic acid, capric acid, lauric acid, myristic acid, palmitic acid, stearic acid, oleic acid, linolic acid, linolenic acid, ricinoleic acid, arachidic acid, behenic acid, or erucic acid and a metal such as Li, Na, Mg, K, Ca, Ba, or Zn.

By using the above-described additives alone or in combination of two or more kinds for the resin, an absolute value of an electric impedance can be easily reduced during flowing described below, and the raw resin is made to be suitable for electrospinning.

Examples of other salts used as the additive include compounds having an alkyl group at a terminal of a structure and having a sulfonate group at any position in the structure (hereinafter, these compounds will also be collectively referred to as alkyl sulfonates).

Specifically, examples of the compound include an alkylbenzene sulfonate (R-Ph-$SO_3M$), a higher alcohol sulfuric acid ester salt (R—O—$SO_3M$), a polyoxy ethylene alkyl ether sulfate (R—O—$(CH_2CH_2O)_n$—$SO_3M$), an alkyl sulfo succinate (R—O—CO—C—C(—$SO_3M$)-O—CO-M), a dialkyl sulfo succinate (R—O—CO—C—C(—$SO_3M$)-O—CO—R), an α-sulfo fatty acid ester (R—CH—(—$SO_3M$)-$COOCH_3$), an α-olefin sulfonate (R—CH═CH—$(CH_2)_n$—$SO_3M$, R—CH(—OH)$(CH_2)_n$—$SO_3M$), an acyltaurine salt (R—CO—NH—$(CH_2)_2$—$SO_3M$), an acylalkyltaurine salt (R—CO—N(—R')—$(CH_2)_2$—$SO_3M$), and an alkane sulfonate (R—$SO_3M$).

These alkyl sulfonates may be used alone or in combination of two or more kinds as a mixture.

In the alkyl sulfonates, R represents an alkyl group, in which the number of carbon atoms is preferably 8 or more and 22 or less, more preferably 10 or more and 20 or less, and even more preferably 12 or more and 18 or less.

R' also represents an alkyl group, in which the number of carbon atoms is preferably 5 or less.

Ph represents a phenyl group that may be substituted.

M represents a monovalent cation, preferably a metal ion, and more preferably a sodium ion.

n represents a number of preferably 6 or more and 24 or less, more preferably 8 or more and 22 or less, and even more preferably 10 or more and 20 or less.

Among these additives, it is preferable to use one kind or two or more kinds selected from the group consisting of the divalent or higher fatty acid salt and the compound having an alkyl group at a terminal of a structure and having a sulfonate group at any position in the structure from the viewpoint of improving the chargeability of the raw resin.

In addition, it is preferable to use an alkane sulfonate (R—$SO_3M$) among the above-described alkyl sulfonates from the viewpoint of more stably charging the raw resin. From this viewpoint, it is more preferable to use a mixture of two or more alkane sulfonates (R—$SO_3M$) where the numbers of carbon atoms in the alkyl groups are different.

As the alkane sulfonate (R—$SO_3M$), a primary alkane sulfonate where a sulfonate group is bonded to a terminal of the structure and a secondary alkane sulfonate where a sulfonate group is bonded to the middle of the structure. From the viewpoint of more stably charging the raw resin, it is preferable to use the secondary alkane sulfonate, and it is more preferable to use a mixture where two or more secondary alkane sulfonates where the number of carbon atoms in the alkyl groups are different are combined.

The proportion of the additive that is mixed with the resin with respect to 100 parts by mass which is the total amount of the resin and the additive is preferably 0.5 parts by mass or more, more preferably 1 part by mass or more, even more preferably 3 parts by mass or more, still more preferably 5 parts by mass or more, still more preferably 7 parts by mass or more, and still more preferably 10 parts by mass or more.

In addition, the proportion of the additive that is mixed with the resin with respect to 100 parts by mass which is the total amount of the resin and the additive is preferably 45 parts by mass or less and more preferably 40 parts by mass or less.

When two or more kinds of the additives are used, the above-described mass proportion is the total amount.

Regarding the impedance, the reason why the temperature of 50° C. is used as "A" in Expression (X) and Expression (I) is to obtain an absolute value of an electric impedance of the resin in a solid state. The reason why the temperature that is 50° C. higher than the melting point is used as "B" in Expression (X) and Expression (I) is to improve fluidity, for example, by melting the resin.

In the following description, the former electric impedance absolute value "A" will also be referred to as "the absolute value of the electric impedance in a solid state", the latter electric impedance absolute value "B" will also be referred to as "the absolute value of the electric impedance during flowing", and the same is applied to the description of both of Expression (X) and Expression (I) unless specified otherwise.

In addition, in the following description, the melt of the constituent resin of the fiber sheet in Expression (X) and the resin as a raw material of the fiber in Expression (I) will also be collectively referred to as "raw resin".

From the viewpoint of suppressing the flow of applied charge to an unintentional portion in the electrospinning method, the absolute value A of the electric impedance of the raw resin in a solid state is preferably $5.0\times10^9\Omega$ or higher and more preferably $1.0\times10^{10}\Omega$ or higher.

In addition, from the same viewpoint, the absolute value A of the electric impedance of the raw resin in a solid state is preferably $1.0\times10^{20}\Omega$ or lower and more preferably $1.0\times10^{18}\Omega$ or lower.

On the other hand, from the viewpoint of improving the chargeability of the raw resin in the electrospinning method, the absolute value B of the electric impedance of the raw resin during flowing is preferably higher than 0Ω.

In addition, from the same viewpoint, the absolute value B of the electric impedance of the raw resin during flowing is preferably $1.0\times10^{10}\Omega$ or lower and more preferably $9.0\times10^9\Omega$ or lower.

By adjusting the absolute value B of the electric impedance of the raw resin during flowing to be in the above-described range, the molten resin in a state where the conductivity is relatively high, that is, the spinning solution including the resin can be charged by electrostatic induction through the nozzles in the electrospinning device described below, and the unintended conduction of a current to the electrospinning device through the molten resin can be reduced.

In addition, from the viewpoint of changing the absolute value of the electric impedance between the value in a solid state and a value in a fluid state caused by, for example the melting the resin to efficiently produce long fibers due to the improvement of the chargeability of the resin, a ratio A/B of the absolute value A of the electric impedance of the raw resin in a solid state to the absolute value B of the electric impedance of the raw resin during flowing is preferably $1.0\times10^2\Omega$ or higher and more preferably $1.1\times10^2\Omega$ or higher.

In addition, from the same viewpoint, A/B is preferably $1.0\times10^{10}\Omega$ or lower and more preferably $1.0\times10^9\Omega$ or lower.

In the present disclosure, from the viewpoint of improving the production efficiency of the long fibers in a melt spinning method, the value of A/B is important. Depending on the kind of the raw resin and the content and kind of the additive, for example, the electric impedance absolute value A in a solid state may be $1.0\times10^{12}\Omega$, and the electric impedance absolute value B during flowing may be $1.0\times10^{10}\Omega$.

In addition, for example, the electric impedance absolute value A in a solid state may be $1.0\times10^{10}\Omega$, and the electric impedance absolute value B during melting may be $1.0\times10^{8}\Omega$.

In addition, in Expression (I), a relationship between the electric impedance absolute value A when the raw resin is a solid and the electric impedance absolute value B when the raw resin is in a molten state is defined. In this case, the raw resin being in a solid state represents that an electric impedance is high such that a current is not likely to flow, and the raw resin being in a molten state represents that an electric impedance is low such that a current is likely to flow.

In a case where the relationship between these electric impedances is applied to the electrospinning method that is the suitable production method according to the present disclosure, when the molten raw resin is discharged from the nozzles, the electric impedance absolute value B during melting functions such that a current caused by a voltage applied from a power source is likely to be strongly generated. As a result, the raw resin in a molten state is likely to be charged, the resins electrically repel each other, and the drawing of the molten resin is further accelerated.

Next, after solidifying the molten resin to be a fibrous solid resin, a current is not likely to flow. Therefore, when the fibrous solid resin is collected by a collecting member such as a collecting portion described later, charge is not likely to be generated. As a result, unintended conduction between the nozzles and the collecting member through the resin can be prevented, and the chargeability for the molten resin can be improved.

Due to this reason, ultrafine fibers can be produced during spinning, and fibers that satisfy Expression (I) are fine.

The absolute value A and the absolute value B of the electric impedances of the raw resin can be measured using the following method.

Unless specified otherwise, "electric impedance" refers to "an absolute value of an electric impedance at a frequency of 0.1 Hz".

[Method of Measuring Electric Impedance of Raw Resin]

The electric impedance is measured using a method illustrated in FIG. 1.

As illustrated in FIG. 1(*a*), a measurement system 130 is configured to include a thermostat 131, a measuring device 132, and a computer 133 for analysis.

As the thermostat 131, a general electric furnace or thermostat of a forced circulation type or a natural convection type can be used.

As the measuring device 132, a general frequency response analyzer can be used. An impedance analyzer (1260, manufactured by Solartron) and a dielectric interface 1296 (manufactured by Solartron) can be used.

In the thermostat 131, as a jig for measuring the electric impedances of the raw resin in a solid state and in a molten state, a jig 134 illustrated in FIG. 1(*b*) to (*d*) can be used.

In order to heat a sample, the jig 134 includes a pair of polyether ether ketone (PEEK) cells (PEEK 450G) 136 and 136 where electrodes 135 and 135 are disposed inside and a seat 138. By using these cells 136, the heating measurement can be performed in the thermostat 131.

A terminal 137 is led out from each of the electrodes 135, and the terminal 137 is connected to the measuring device 132.

As illustrated in FIG. 1(*c*), the pair of cells 136 and 136 are disposed to face each other such that the electrodes 135 and 135 face each other, and are disposed in the seat 138 and fixed. In this state, a given gap is generated between the electrodes 135 and 135 disposed to face each other.

The electrode 135 in the cell 136 can be formed of, for example, stainless steel, and the dimensions thereof are a width of 20 mm, a length of 30 mm, and a thickness of 8 mm. The distance between the pair of electrodes 135 and 135 is 2 mm.

All of the surfaces of the electrodes 135 and 135 other than electrode surfaces facing each other and an upper surface that is a feeding surface of a sample are covered with the PEEK cells without a gap.

The applied voltage is set as AC 0.1 V in the measurement at 210° C. for the molten state and is set as AC 1 V in the measurement at 50° C. for the solid state, and the applied frequency is 0.1 Hz.

The measurement temperature is set as 50° C. in the solid state and is set as 210° C. in the molten state (when the melting point is 160° C.). The measurement environment is 23° C. and 40% RH.

The measurement procedures of the electric impedance are as follows. The components (the raw resin, the additive, and the like) of the fibers forming the fiber sheet and the contents thereof can be measured using a well-known analyzer. Therefore, the electric impedance is measured using the following method based on the measurement result, and whether or not the fibers forming the fiber sheet satisfy Expression (I) above is determined.

(1) The raw resin and optionally the additive are weighed at a predetermined ratio and are mixed such that the total amount thereof is 5 g, and the mixture is used as a measurement sample. For example, when 5 mass % of the additive is mixed, 4.75 g of the resin and 0.25 g of the additive are mixed.

(2) The jig 134 is disposed in the thermostat 131, and the thermostat 131 is heated to 210° C. to heat the jig 134 at the same time.

(3) 5 g of the measurement sample is melted (is heated in the thermostat 131 for about 10 minutes until it is transparent.)

(4) As illustrated in FIG. 1(*d*), a molten measurement sample 139 is cast into the jig 134 and is left to stand until it is stabilized at 210° C. again.

(5) The temperature in the thermostat 131 is gradually decreased from 210° C. to 50° C., and the electric impedance at each of the temperatures is measured. Five samples are prepared using the same method, the maximum value and the minimum value are excluded, and the arithmetic mean value of the three samples is obtained.

When whether or not the entire fiber sheet satisfies Expression (X) is determined, in the measurement procedures of the electric impedance, the procedure (1) is not performed, and the subsequent steps are performed by using the fiber sheet as the measurement sample in the procedure (3).

In the fiber sheet, it is preferable that the number of fused portions between the constituent fibers is a predetermined number or less. Specifically, from the viewpoint that, as the number of welded portions increases, the fiber sheet is harder such that the texture of the sheet deteriorates, the number of fused portions between constituent fibers per 0.10 $mm^2$ of the fiber sheet is preferably 20 or less, more preferably 15 or less, and even more preferably 10 or less.

From the viewpoint that, as the number of the welded portions increases, the fiber sheet is harder such that the texture of the sheet deteriorates, the number of fused portions between constituent fibers per 0.10 $mm^2$ of the fiber sheet is preferably as small as possible and is preferably 0 or more.

Whether or not the fused portions are present in the fiber sheet, and the number thereof can be measured using the following method. Specifically, the fiber sheet as a measurement target is observed in a plan view at 1 000-fold magnification using a SEM, and intersections of fibers present in a field of view of 127 μm×100 μm are observed. At the intersections of the fibers, portions where an interface between the fibers is unclear are determined as fused portions, and the number of the fused portions is measured. By performing this measurement on 10 fields of view, the arithmetic mean value of the numbers of the fused portions in the independent 10 fields of view is obtained as the number of the fused portions in the present disclosure.

The fiber sheet according to each of the embodiments can be produced using an electrospinning device used in an electrospinning method. Typically, the electrospinning device includes: a storage portion that stores the spinning solution as a raw material of the fibers; a conductive nozzle that discharges the spinning solution; and a power source that applies a voltage to the nozzle. As the electrospinning device having this configuration, for example, an electrostatic spraying device illustrated in FIG. 1 of Japanese Patent Laid-Open No. 2017-95825, an electrostatic spraying device illustrated in FIGS. 1 to 6 of Japanese Patent Laid-Open No. 2017-71881, or an electrostatic spraying device illustrated in FIGS. 1 to 6 of Japanese Patent Laid-Open No. 2019-245204 can also be used.

In the fiber sheet having the above-described configuration, the basis weight distribution is uniform. A fiber sheet can be produced with a minimum basis weight required to exhibit desired performance for the fiber sheet, for example, filtration performance. As a result, a reduction in raw material cost and high productivity can be implemented.

In particular, in one embodiment of a preferable aspect of the fiber sheet, even when a fiber sheet is configured to include two or more different kinds of fibers, for example, include the first fibers and the second fibers having a larger fiber diameter than the first fibers, unintended uneven distribution of the fibers or uneven distribution of the same kind of fibers can be reduced. Therefore, a fiber sheet having a uniform basis weight distribution in a state where the fibers are uniformly mixed is provided.

Hereinafter, preferable embodiments of the electrospinning device according to the present disclosure and a method of producing a fiber sheet using the electrospinning device will be described.

Typically, the electrospinning device according to the present disclosure includes: a plurality of nozzles that discharge a spinning solution including a resin; and a plurality of power sources for applying charge to the spinning solution. It is preferable that the power sources are connected to the plurality of nozzles or a plurality of electrodes such that different charges are applied to the spinning solutions discharged from the nozzles.

The meaning of the spinning solution including the resin includes both of a solution including the raw resin and a heated melt of the raw resin.

It is preferable that the electrospinning device according to the present disclosure further includes an electrode in addition to the plurality of nozzles and the plurality of power sources. It is preferable that the electrode is disposed distant from the nozzle.

Examples of an embodiment of the electrode include an embodiment in which a collecting electrode is disposed to face the nozzle in a direction substantially perpendicular to a direction in which each of the nozzles extends and an embodiment in which a charging electrode is disposed to surround the nozzle.

Any one of these electrodes may be provided singly or in plural, or both of these electrodes may be each independently provided singly or in plural.

In the electrospinning device according to the present disclosure, the power source is connected to any one of the nozzle, the collecting electrode, or the charging electrode, and an electric field is formed between the nozzle and any one of the collecting electrode and the charging electrode. As a result, the spinning solution discharged from each of the nozzles can be positively or negatively charged.

For example, when the power source is electrically connected to the nozzle and a positive voltage is applied from the power source, positive charge is applied to the spinning solution. On the other hand, when a negative voltage is supplied from the power source, negative charge is applied to the spinning solution.

Instead, for example, when the power source is electrically connected to the electrode and a positive voltage is applied from the power source, negative charge is applied to the spinning solution. On the other hand, when a negative voltage is supplied from the power source, positive charge is applied to the spinning solution.

Figure 2A:
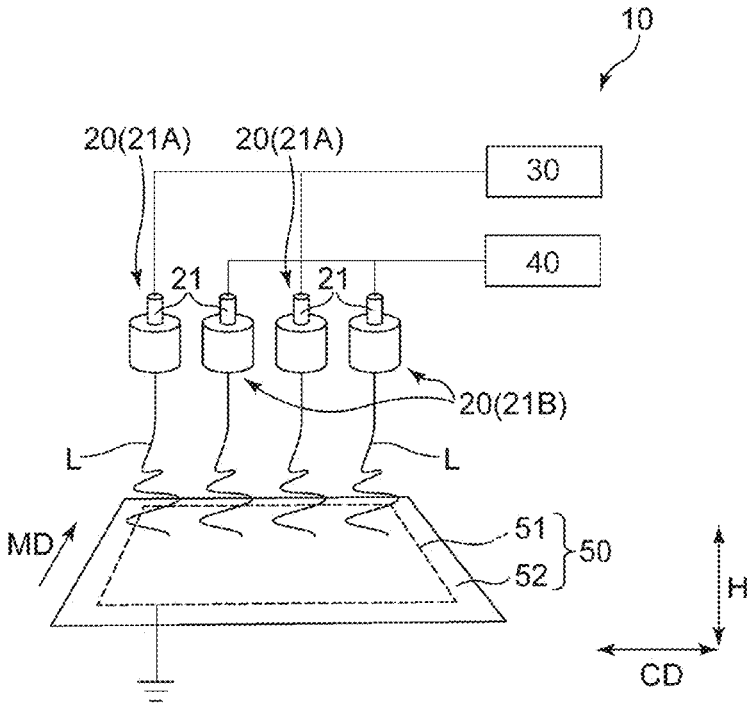
FIG. 2(*a*) is a perspective view illustrating one embodiment of an electrospinning device according to the present disclosure, and FIG. 2(*b*) is a schematic cross-sectional view illustrating a spinning unit constituting the electrospinning device illustrated in FIG. 2(*a*).
Figure 2B:
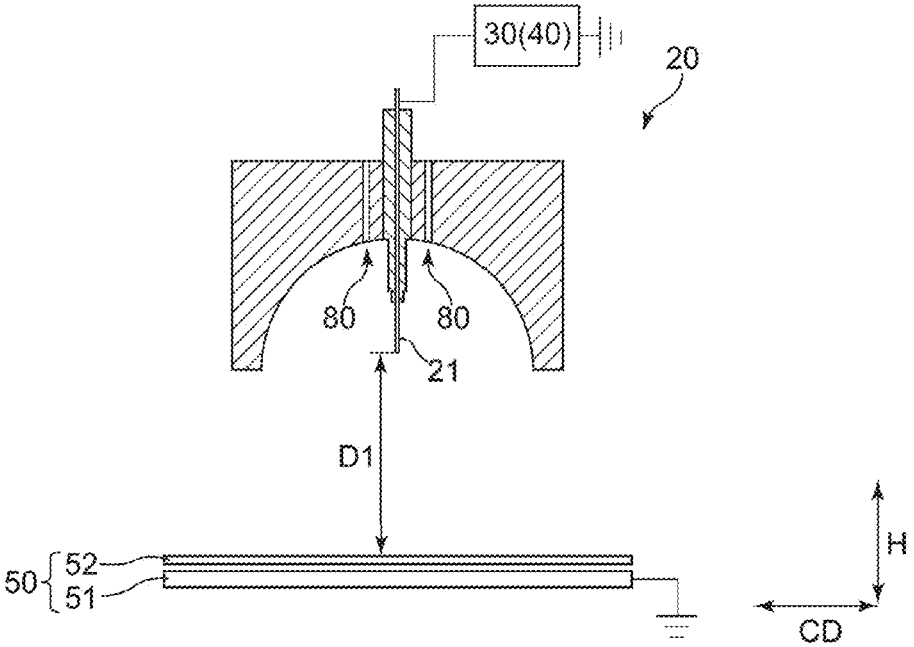

FIGS. 2(*a*) and 2(*b*) schematically illustrate one embodiment of the electrospinning device for producing the fiber sheet according to the present disclosure. An electrospinning device 10 illustrated in FIG. 2(*a*) includes a plurality of spinning units 20 and a plurality of power sources 30 and 40.

Electrospinning is a method of discharging a solution or a melt including a resin as a raw material of fibers into an electric field in a state where a high voltage is applied such that the discharged liquid can be finely drawn to form ultrafine fibers.

The spinning unit 20 is a member that discharges a solution including the raw resin or a melt of the raw resin into an electric field and spins the solution of the melt.

The spinning unit 20 is disposed to face a collecting portion 50 described below.

In the following description, the solution including the raw resin and the melt of the raw resin will also be collectively referred to as "spinning solution".

The spinning unit 20 illustrated in FIGS. 2(*a*) and 2(*b*) includes a nozzle 21 that discharges the spinning solution L.

The nozzle 21 is a hollow member that is formed of a conductive material such as metal, communicates with a spinning solution supply portion (not illustrated), and can discharge the spinning solution supplied from the spinning solution supply portion.

The electrospinning device 10 illustrated in the same drawing include a plurality of nozzles 21 by disposing the plurality of spinning units 20 at intervals.

Each of the nozzles 21 is electrically connected one of a first power source 30 or a second power source 40 that applies a power to the nozzle 21.

Regarding the nozzles 21 illustrated in FIGS. 2(*a*) and 2(*b*), when it is assumed that one or more nozzles 21 belong to a first nozzle group 21A and nozzles 21 not belonging to the first nozzle group 21A belong to a second nozzle group 21B, the power sources are connected such that a polarity of a voltage applied to the nozzles 21 belonging to the first nozzle group 21A and a polarity of a voltage applied to the nozzles 21 belonging to the second nozzle group 21B are different from each other. As a result, charges having different polarities are applied to the spinning solutions discharged from the nozzles. Specifically, charges having different polarities are applied to the spinning solution discharged from the first nozzle group and the spinning solution discharged from the second nozzle group.

When the electrospinning device 10 illustrated in FIG. 2(*a*) is used as an example, the electrospinning device 10 includes four spinning units 20, and each of the spinning units 20 includes one nozzle 21.

Among the four nozzles 21, two nozzles 21 are connected to the first power source 30, and these nozzles 21 belong to the first nozzle group 21A.

In addition, two nozzles 21 not belonging to the first nozzle group 21A are connected to the second power source 40, and these nozzles 21 belong to the second nozzle group 21B.

The first power source 30 and the second power source 40 can generate voltages such that polarities of the voltages are different from each other. That is, when the voltage generated from the first power source 30 is positive, the voltage generated from the second power source 40 is negative.

Instead, when the voltage generated from the first power source 30 is negative, the voltage generated from the second power source 40 is positive.

This way, the power sources 30 and 40 are connected such that the polarity of the voltage applied to the nozzles 21 belonging to the first nozzle group 21A and the polarity of the voltage applied to the nozzles 21 belonging to the second nozzle group 21B are different from each other. In addition, as a result, different charges are applied to the spinning solutions discharged from the nozzles.

As each of the first power source 30 and the second power source 40, a well-known device such as a DC high voltage power source can be used.

As illustrated in FIGS. 2(*a*) and 2(*b*), the electrospinning device 10 may include the collecting portion 50.

As illustrated in the same drawing, the electrospinning device 10 includes: a collecting electrode 51 that collects fibers formed by solidification of the spinning solution and the like; and a conveyance belt 52 that conveys deposited fibers.

The collecting portion 50 illustrated in the same drawing is provided downward in a vertical direction H of the spinning unit 20.

The collecting electrode 51 illustrated in FIGS. 2(*a*) and 2(*b*) is a flat member that is formed of a conductive material such as metal.

A plate surface of the collecting electrode 51 is substantially perpendicular to the direction in which each of the nozzles 21 extends.

The collecting electrode 51 illustrated in the same drawing is grounded, and an electric field is formed between each of the nozzles 21 to which a voltage is applied and the collecting electrode 51. By discharging the spinning solution in this charged state, electrospinning can be performed.

The conveyance belt 52 is disposed between the nozzle 21 and the collecting electrode 51, and the conveyance belt 52 moves in one direction MD such that fibers deposited on the conveyance belt 52 can be conveyed.

Examples of the conveyance belt 52 include an aspect where an endless belt or a long strip-shaped belt that is stretched between two conveyance rolls (not illustrated) is unwound from a roll-shaped wound body.

As the conveyance belt 52, for example, a film, a mesh, nonwoven fabric, or paper can be used.

Figure 3A:
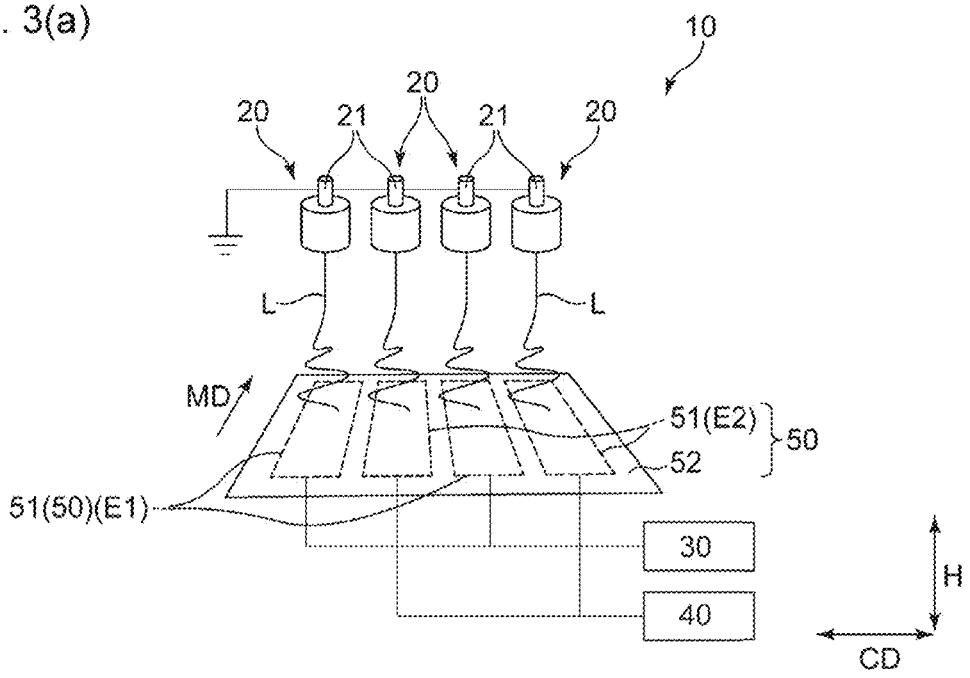
FIG. 3(*a*) is a perspective view illustrating another embodiment of the electrospinning device according to the present disclosure, and FIG. 3(*b*) is a cross-sectional view illustrating a spinning unit constituting the electrospinning device illustrated in FIG. 3(*a*).
Figure 3B:
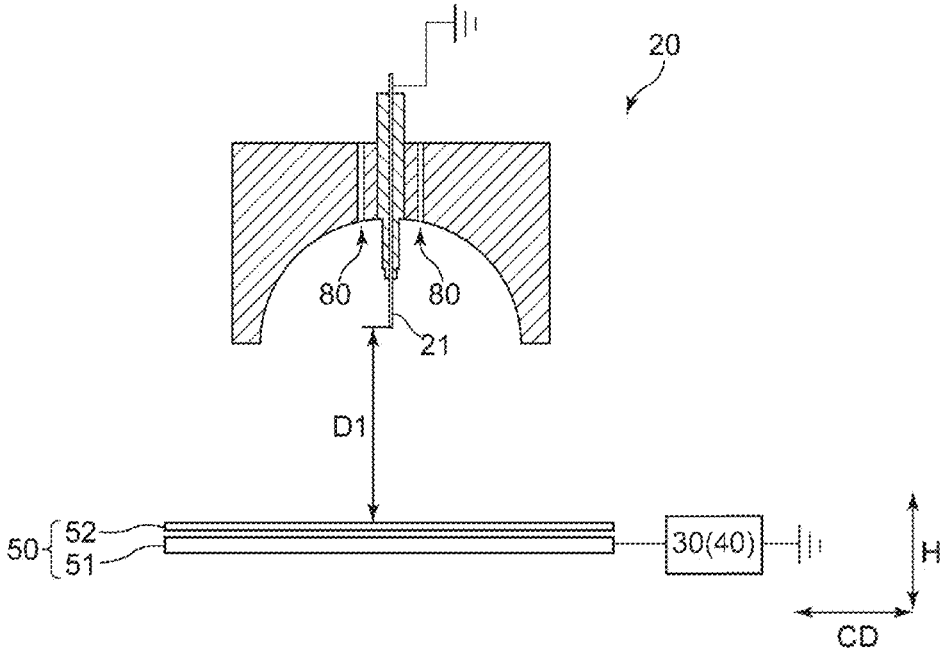
Figure 4A:
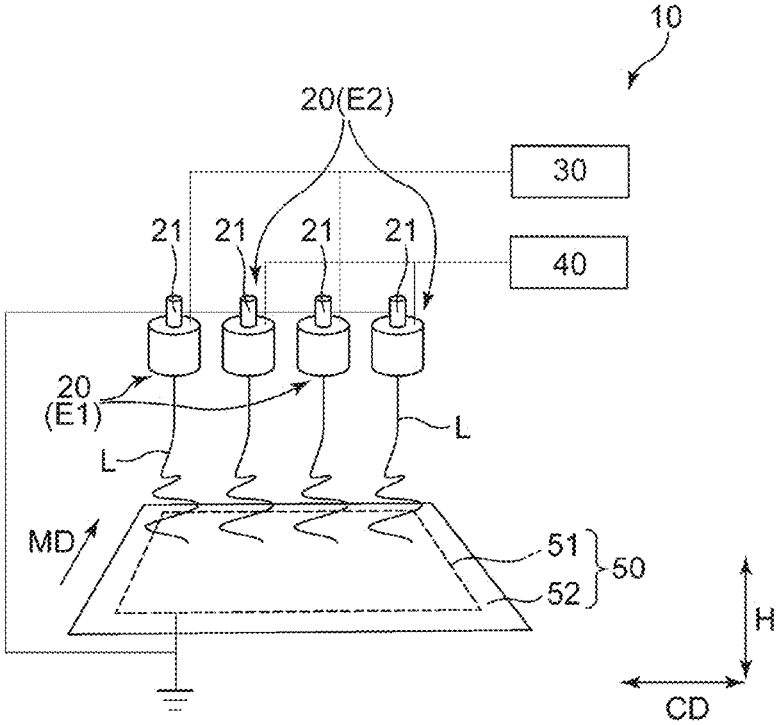
FIG. 4(*a*) is a perspective view illustrating still another embodiment of the electrospinning device according to the present disclosure, and FIG. 4(*b*) is a cross-sectional view illustrating a spinning unit constituting the electrospinning device illustrated in FIG. 4(*a*).
Figure 4B:
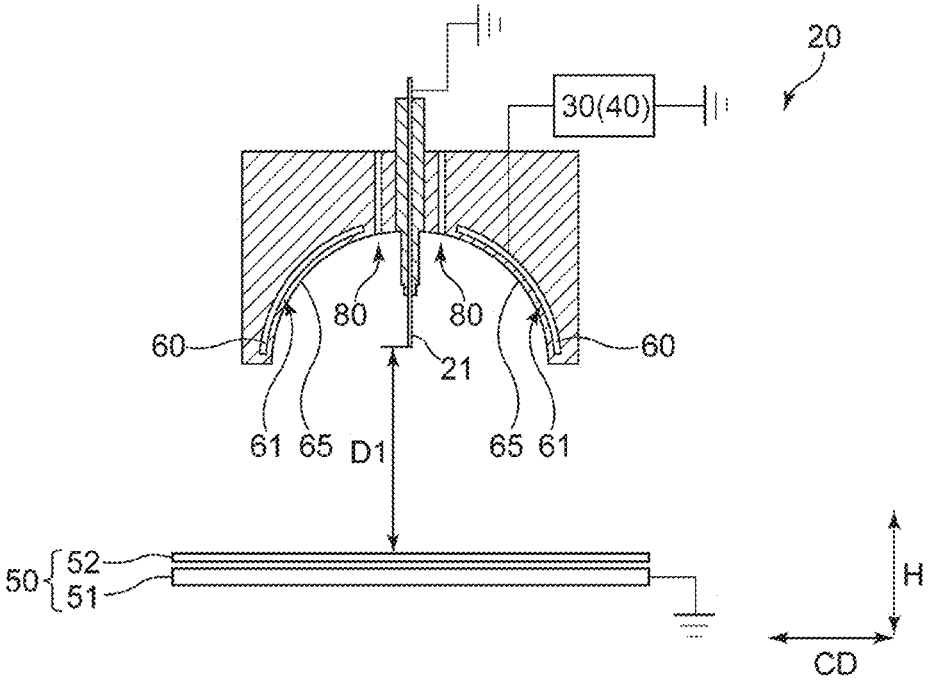
Figure 5A:
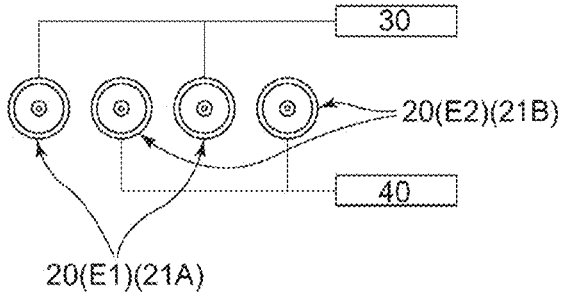
FIGS. 5(*a*) to (*d*) are schematic diagrams illustrating disposition positions of nozzles in the electrospinning device according to the present disclosure when seen from the top.
Figure 5B:
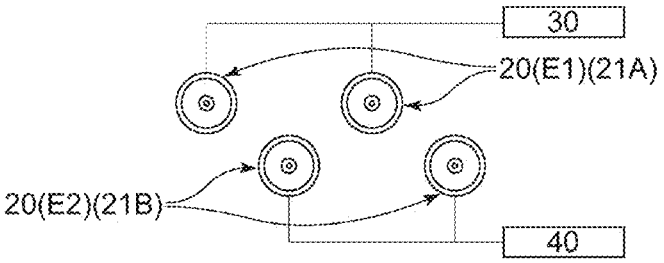
Figure 5C:
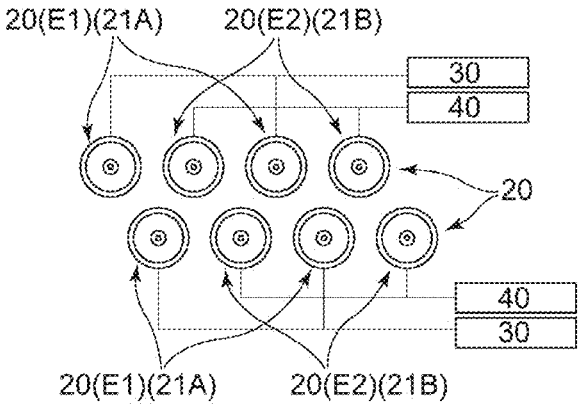
Figure 5D:
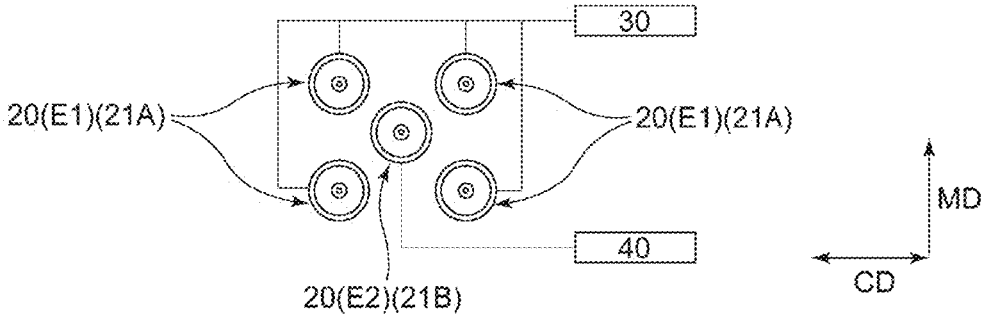

Instead of the embodiment illustrated in FIGS. 2(*a*) and 2(*b*), the electrospinning device 10 can adopt an embodiment illustrated in FIGS. 3(*a*) and 3(*b*) or an embodiment illustrated in FIGS. 4(*a*) and 4(*b*).

In the following description, portions different from those of the embodiment illustrated in FIGS. 2(*a*) and 2(*b*) will be mainly described, and the description regarding the above-described embodiment is appropriately applied to the same portions as those of the above-described embodiment.

In FIGS. 3(*a*) and 3(*b*) and FIGS. 4(*a*) and 4(*b*), the same members as those illustrated in FIGS. 2(*a*) and 2(*b*) are represented by the same reference numerals.

In the electrospinning device 10 illustrated in FIGS. 3(*a*) and 3(*b*), the electrical connection between the nozzle 21 and the collecting portion 50 is different from that of the embodiment illustrated in FIGS. 2(*a*) and 2(*b*).

The electrospinning device 10 illustrated in FIGS. 3(*a*) and 3(*b*) includes a plurality of nozzles 21, and each of the nozzles 21 is grounded.

On the other hand, the collecting portions 50 form electrode groups including of a plurality of collecting electrodes 51.

The collecting electrodes 51 forming the electrode groups are disposed at intervals in a direction CD perpendicular to the conveyance direction MD of the conveyance belt 52.

Among the plurality of collecting electrodes 51, when it is assumed that one or more collecting electrodes 51 belong to a first electrode group E1 and collecting electrodes 51 not belonging to the first electrode group E1 belong to a second electrode group E2, the first power source 30 is connected to the collecting electrodes 51 belonging to the first electrode group E1, and the second power source 40 is connected to the collecting electrodes 51 belonging to the second electrode group E2.

As a result, a polarity of a voltage applied to the collecting electrodes 51 belonging to the first electrode group E1 and a polarity of a voltage applied to the collecting electrodes 51 belonging to the second electrode group E2 are different from each other.

In the electrospinning device 10 illustrated in FIGS. 3(*a*) and 3(*b*), an electric field is formed between each of the grounded nozzles 21 and each of the collecting electrodes 51 present at a position facing the nozzle 21.

As a result, different charges are applied to the spinning solutions discharged from the nozzles. By discharging the spinning solution in this charged state, the fibers can be electrospun.

Examples of another embodiment of the first electrode group E1 and the second electrode group E2 include an embodiment illustrated in FIGS. 4(*a*) and 4(*b*). In this embodiment, one spinning unit 20 includes: the nozzle 21; and a charging electrode 60 for charging the nozzle 21 to generate an electric field between the nozzles 21.

The charging electrode 60 is formed of a conductive material such as metal.

In the same drawing, the charging electrodes 60 are disposed in a substantially bowl shape to surround the nozzles 21, and the nozzles 21 and the charging electrodes 60 are distant from each other.

A surface of the charging electrode 60 facing the nozzle 21 is formed in a concave curved surface shape.

For convenience of the description, in the following description, the surface of the charging electrode 60 facing the nozzle 21 will also be referred to as "concave curved surface 61".

The charging electrode 60 has an open end on a tip end side of the nozzle 21, and a planar shape of the open end is a circular shape such as a true circular shape or an elliptical shape.

The charging electrode 60 is connected to the first power source 30 or the second power source 40, and a positive or negative voltage is applied thereto from each of the power sources.

It is preferable that the centroid of the planar shape of the open end of the charging electrode 60 is disposed such that the nozzle 21 is positioned thereon from the viewpoint of improving the chargeability of the spinning solution.

The electrospinning device 10 illustrated in FIGS. 4(*a*) and 4(*b*) includes a plurality of nozzles 21 and a plurality of charging electrodes 60 by disposing a plurality of spinning units 20 including the nozzle 21 and the charging electrode 60.

These charging electrodes 60 comprises: the charging electrodes 60 that belong to the first electrode group E1 and are connected to the first power source 30; and the charging electrodes 60 that belong to the second electrode group E2 and are connected to the second power source 40.

As a result, a polarity of a voltage applied to the charging electrodes 60 belonging to the first electrode group E1 and a polarity of a voltage applied to the charging electrodes 60 belonging to the second electrode group E2 are different from each other. With this configuration, different charges are applied to the spinning solutions discharged from the nozzles.

As described above in each of the embodiments, in the electrospinning device according to the present disclosure, it is preferable that one kind or two or more kinds among the nozzles 21 to which voltages having the same polarity are applied, the charging electrodes 60 to which voltages having the same polarity are applied, and the first power sources 30 or the second power sources 40 that apply voltages having the same polarity are each independently disposed in plural.

Examples of the specific disposition include an aspect where one first power source 30 or one second power source 40 and a plurality of nozzles 21 or a plurality of charging electrodes 60 that are electrically connected to one of the power sources are disposed. Instead, for example, an aspect may be adopted where a plurality of nozzles 21 or a plurality of charging electrodes 60 are provided and a plurality of first power sources 30 and a plurality of second power sources 40 are electrically connected to the nozzles 21 or the charging electrodes 60, respectively. However, the present disclosure is not limited to these aspects.

In the electrospinning device according to each of the embodiments having the above-described configuration, even when the fibers are electrospun in a state where a plurality of nozzles that discharge the spinning solution are provided, polarities of the charged spinning solutions are controlled to be different. Therefore, electrical attraction is likely to be generated between the spinning solutions discharged from the nozzles, the spinning solutions are drawn to be uniformly dispersed in a plane direction of the collecting portion, and the spinning solutions are deposited as fibers. As a result, a fiber sheet where unevenness of a basis weight distribution is not likely to be generated can be produced using an electrospinning method.

Furthermore, when fibers are spun using a plurality of spinning units that are different in at least one of conditions such as a nozzle diameter, the amount of the raw resin discharged, and a voltage during electrospinning, long fibers having different fiber diameters are formed. Regarding this point, according to the present invention, polarities of the charged spinning solutions are controlled to be different, and electrical attraction is likely to be generated between the spinning solutions discharged from the nozzles. Therefore, the spinning solutions can be drawn to be uniformly dispersed in the plane direction, and can be deposited as long fibers while being mixed. As a result, a plurality of fiber groups can be spun in a single step, and a fiber sheet where unevenness of distributions of the fibers is not likely to occur can be produced using an electrospinning method.

Further, in the electrospinning device according to each of the embodiments having the above-described configuration, polarities of the charged spinning solutions are controlled to be different. Therefore, even when the composition of the spinning solution supplied to one spinning unit and the composition of the spinning solution supplied to another spinning unit are different from each other, long fibers having different physical properties can be spun in a single step, and a fiber sheet where unevenness of distributions of the fibers is not likely to occur can be produced using an electrospinning method.

From the viewpoint further improving the above-described effect, in the embodiment illustrated in FIGS. 2(*a*) and 2(*b*), it is preferable that the nozzles 21 belonging to the first nozzle group 21A and the nozzles 21 belonging to the second nozzle group 21B are disposed adjacent to each other. That is, it is preferable that polarities of voltages applied to the adjacent nozzles 21 are different from each other.

Likewise, in the embodiment illustrated in FIGS. 3(*a*) and 3(*b*), it is preferable that the collecting electrodes 51 belonging to the first electrode group E1 and the collecting electrodes 51 belonging to the second electrode group E2 are disposed adjacent to each other. That is, it is preferable that polarities of voltages applied to the adjacent collecting electrodes 51 are different from each other.

In addition, likewise, in the embodiment illustrated in FIGS. 4(*a*) and 4(*b*), it is preferable that the charging electrodes 60 belonging to the first electrode group E1 and the charging electrodes 60 belonging to the second electrode group E2 are disposed adjacent to each other. That is, it is preferable that polarities of voltages applied to the adjacent charging electrodes 60 are different from each other.

In a case where the spinning units and the electrodes are arranged in one direction, when attention is paid to any one nozzle 21 or electrode, "adjacent" described in the present description literally refers to another nozzle 21 or electrode adjacent to the one nozzle 21 or electrode. In a case where the spinning units and the electrodes are not arranged in one direction, "adjacent" refers to another nozzle 21 in the spinning unit that has at least the shortest distance from the one nozzle 21. In addition, when attention is paid to any one electrode, "adjacent" refers to another electrode that has at least the shortest distance from the electrode.

Examples of a disposition aspect of the nozzles or the electrodes that satisfy the above-described disposition include an aspect illustrated in FIGS. 5(*a*) to (*d*).

In the present disclosure, actually, the aspect where the power source is connected to any one of the nozzle 21, the collecting electrode 51, or the charging electrode 60. For convenience of the explanation, the explanation is made as a schematic diagram where, when each of the spinning units 20 is seen from the top, the power source is connected to the charging electrode 60 in each of the spinning units 20.

In the disposition aspect illustrated in FIG. 5(*a*), a spinning unit array where the plurality of spinning units 20 are disposed in a row in the perpendicular direction CD is formed, and when the spinning unit array is seen in the perpendicular direction CD, the power sources are connected such that polarities of the voltages applied to the spinning units 20 alternately change.

In the disposition aspect illustrated in FIG. 5(*b*), the plurality of spinning units 20 are disposed to be alternately positioned back and forth in the conveyance direction MD, and the power sources are connected such that a polarity of a voltage applied to the spinning units 20 that are positioned on the downstream side in the conveyance direction MD and a polarity of a voltage applied to the spinning units 20 that are positioned on the upstream side in the conveyance direction MD are different from each other.

In addition, in the disposition aspect illustrated in FIG. 5(*c*), a plurality of the spinning unit arrays illustrated in FIG. 5(*a*) are disposed back and forth in the conveyance direction MD.

In the disposition aspect illustrated in FIG. 5(*d*), one spinning unit 20 is disposed, and a plurality of spinning units 20 are disposed to surround the one spinning unit 20 such that polarities of voltages applied to the spinning units 20 are different from each other.

Even in any of the embodiments, with the above-described configuration, electrical attraction is likely to be further generated between the spinning solutions discharged from the nozzles 21. Therefore, the spinning solutions are deposited while being further drawn to be uniformly dispersed in the plane direction of the collecting portion. As a result, the occurrence of unevenness of a basis weight distribution is further reduced, and a fiber sheet including fibers having a smaller fiber diameter can be produced using an electrospinning method.

In addition, even when different kinds of fibers are spun, the occurrence of unevenness of the fibers is further reduced, and a fiber sheet including fibers having a smaller fiber diameter can be produced using an electrospinning method.

In the embodiment illustrated in FIGS. 4(*a*) and 4(*b*), it is preferable that the spinning unit 20 includes an electrical insulating wall portion 65 that is disposed at least on the concave curved surface 61 as the surface of the charging electrode 60 facing the nozzle 21, and it is more preferable that the wall portion 65 is disposed to cover the entire surface of the charging electrode 60.

In addition, it is also preferable that the wall portion 65 is disposed in direct contact with the charging electrode 60.

As a result, discharge between the nozzle 21 and the charging electrode 60 and between the charging electrodes 60 can be prevented, and fibers can be stably electrospun.

Furthermore, the chargeability of the nozzle 21 can be improved. Therefore, there is an advantageous effect in that the drawing efficiency of the spinning solution caused by the Coulomb's force can be improved and fibers having a smaller fiber diameter can be produced.

It is preferable that the wall portion 65 is formed of, for example, a ceramic material or a dielectric (insulator) such as a resin-based material.

In addition, as illustrated in FIGS. 2(*b*), 3(*b*), and 4(*b*), it is preferable that the electrospinning device 10 includes a gas flow jetting portion 80 that jets a gas flow to the outside of the spinning unit 20.

In each of the drawings, the gas flow jetting portion 80 can jet a gas flow from a rear end of each of the nozzle 21 toward a tip end of the nozzle in a direction in which the nozzle 21 extends.

When the spinning unit 20 is seen from the front, one or more gas flow jetting portions 80 are disposed outside of the position of the nozzle 21.

The gas flow jetting portion 80 includes a gas flow generation portion (not illustrated), and the gas flow generation portion can supply the jetted gas flow to the gas flow jetting portion 80.

The tip end of the nozzle 21 refers to one end of the nozzle 21 positioned in a direction in which the spinning solution L is discharged.

From the viewpoint of convenience, for example, an air flow can be used as the gas flow. With this configuration, the drawing efficiency of the melt can be improved due to the external force of the gas flow in contact, and ultrafine fibers having a reduced fiber diameter can be efficiently produced.

A constituent material of the gas flow jetting portion 80 is not particularly limited, and is preferably selected in consideration of the chargeability of the nozzle 21. For example, the same material as that of the wall portion 65 can be used.

As a polymer compound used for the spinning solution, for example, the above-described thermoplastic resin can be used. These resins can be used alone or in combination with two or more kinds.

When a solution in which the polymer compound is dissolved or dispersed in a solvent is used as the spinning solution, examples of the solvent include water, methanol, ethanol, 1-propanol, 2-propanol, hexafluoroisopropanol, tetraethylene glycol, triethylene glycol, dibenzyl alcohol, 1,3-dioxolane, 1,4-dioxane, methyl ethyl ketone, methyl isobutyl ketone, methyl-n-hexyl ketone, methyl-n-propyl ketone, diisopropyl ketone, diisobutyl ketone, acetone, hexafluoroacetone, phenol, formic acid, methyl formate, ethyl formate, propyl formate, methyl benzoate, ethyl benzoate, propyl benzoate, methyl acetate, ethyl acetate, propyl acetate, dimethyl phthalate, diethyl phthalate, dipropyl phthalate, methyl chloride, ethyl chloride, methylene chloride, chloroform, o-chlorotoluene, p-chlorotoluene, carbon tetrachloride, 1,1-dichloroethane, 1,2-dichloroethane, trichloroethane, dichloropropane, dibromoethane, dibromopropane, methyl bromide, ethyl bromide, propyl bromide, acetic acid, benzene, toluene, hexane, cyclohexane, cyclohexanone, cyclopentane, o-xylene, p-xylene, m-xylene, acetonitrile, tetrahydrofuran, N,N-dimethylformamide, and pyridine. The solvent is not limited to one kind, and plural kinds of solvents may be freely selected from the exemplary solvents and mixed to be used.

In particular, when water is used as the solvent, a natural polymer or a synthetic polymer described below having high solubility in water are suitably used.

Examples of the natural polymer include a mucopolysaccharide such as pullulan, hyaluronic acid, chondroitin sulfate, poly-γ-glutamic acid, modified corn starch, β-glucan, glucooligosaccharide, heparin, or keratosulfate, cellulose, pectin, xylan, lignin, glucomannan, galacturonic acid, psyllium seed gum, tamarind seed gum, gum arabic, gum tragacanth, water-soluble soybean polysaccharide, alginic acid, carrageenan, laminaran, agar (agarose), fucoidan, methyl cellulose, hydroxy propyl cellulose, and hydroxy propyl methyl cellulose.

Examples of the synthetic polymer include partially saponified polyvinyl alcohol, low saponified polyvinyl alcohol, polyvinyl pyrrolidone, polyethylene oxide, and sodium polyacrylate.

These polymer compounds can be used alone or in combination with two or more kinds.

Among these polymer compounds, from the viewpoint of easily spinning fibers, pullulan, partially saponified polyvinyl alcohol, low saponified polyvinyl alcohol, polyvinyl pyrrolidone, or polyethylene oxide is preferably used.

In addition, although the solubility in water is not high, a polymer compound such as completely saponified polyvinyl alcohol, partially saponified polyvinyl alcohol, oxazoline-modified silicone, or Zein (major component of corn protein) can also be used.

The completely saponified polyvinyl alcohol can be treated to be insoluble after the formation of fibers.

The partially saponified polyvinyl alcohol can be cross-linked after the formation of fibers by using a crosslinking agent in combination.

Examples of the oxazoline-modified silicone include a poly(N-propanoylethyleneimine)-grafted dimethyl siloxane/γ-aminopropylmethylsiloxane copolymer.

These polymer compounds can be used alone or in combination with two or more kinds.

Among these, from the viewpoints of reducing the number of production steps such as a dispersion step in the solvent to improve the production efficiency of fibers and easily spinning ultrafine fibers, the spinning solution is preferably a molten resin, that is, a melt including a resin and is more preferably a melt including a thermoplastic resin.

When the melt including a thermoplastic resin is used as the spinning solution, from the viewpoints of further improving the chargeability of the melt and easily obtaining ultrafine fibers, it is also preferable to use the electrospinning device 10 according to the aspect illustrated in FIGS. 4(*a*) and 4(*b*).

When the melt including a thermoplastic resin is used as the spinning solution, the thermoplastic resin to be used has fiber formability in melt electrospinning and has a melting point. Examples of the resins include the above-described thermoplastic resins.

The diameter of the nozzle 21 can be set, as the inner diameter, to be preferably 100 μm or more and more preferably 200 μm or more.

In addition, the diameter of the nozzle 21 can be set, as the inner diameter, to be preferably 3 000 μm or less and more preferably 2 000 μm or less.

By setting the diameter of the nozzle to be in this range, the spinning solution L can be easily and quantitatively fed, and the spinning solution L can be efficiently charged.

The diameter of the nozzle 21 may vary depending on the spinning units, the diameters of the nozzles 21 in the spinning units to which voltages having the same polarity are applied may be the same and the diameters of the nozzles 21 in the spinning units to which voltages having different polarities are applied may be different, or the diameters of the nozzles 21 in all of the spinning units may be the same.

Hereinabove, the electrospinning device according to the present invention is described, and a method of producing a fiber sheet using the electrospinning device 10 is as follows.

Specifically, a voltage is applied from each of the power sources 30 and 40 to each of nozzles 21, each of the collecting electrodes 51, or each of the charging electrodes 60 to generate an electric field. In this state, the spinning solution is discharged into an electric field from the tip end of the nozzle 21 to electrospin fibers, and the fibers spun from the spinning solution are deposited on the collecting portion 50.

In addition, from the viewpoint of efficiently obtaining long fibers having a small fiber diameter, it is also preferable that the spinning solution is discharged from the nozzle 21 to electrospin fibers in a state where a gas flow is jetted from the gas flow jetting portion 80.

The electrospinning device according to the present disclosure can be applied to both of an electrospinning method using a resin solution and an electrospinning method using a molten resin.

That is, the fiber sheet is produced with an electrospinning method using a resin-containing solution or a resin-containing melt, and is preferably used with a melt electrospinning method using a melt of a resin.

The spinning solution including a resin discharged from the tip end of the nozzle 21 is refined while being drawn by the Coulomb's force generated therein and preferably the jetting of a gas flow. When a solution including a resin and a solvent is used, the resin is solidified while the solvent is instantaneously evaporated during drawing, and a fine fibrous material is obtained.

In addition, when a melt of a resin is used, the melt is cooled and solidified while being drawn, and a fine fibrous material is obtained.

Further, when the spinning solution is drawn, the spinning solutions are drawn while being attracted to each other by electrical attraction generated between the spinning solutions having charges with different polarities, and the solidified material is randomly deposited on the collecting portion 50.

As a result, a fiber sheet including ultrafine fibers and having small basis weight unevenness is formed. Further, when plural kinds of fibers are included, a fiber sheet having small distribution unevenness of fibers is formed.

From the viewpoint of promoting the generation of electrical attraction between the spinning solutions having charges with different polarities to improve the drawability of the spinning solution and improving the formation efficiency of the fiber sheet where ultrafine fibers are randomly deposited, when the electrospinning device 10 illustrated in FIGS. 2(*a*) and 2(*b*) is used, it is preferable that the fibers are electrospun in a state where the nozzles 21 belonging to the first nozzle group 21A and the nozzles 21 belonging to the second nozzle group 21B are disposed adjacent to each other.

From the same viewpoint, when the electrospinning device 10 illustrated in FIGS. 3(*a*) and 3(*b*) is used, it is preferable that the fibers are electrospun in a state where the collecting electrodes 51 belonging to the first electrode group E1 and the collecting electrodes 51 belonging to the second electrode group E2 are disposed adjacent to each other.

In addition, from the same viewpoint, when the electrospinning device 10 illustrated in FIGS. 4(*a*) and 4(*b*) is used, it is preferable that the charging electrodes 60 belonging to the first electrode group E1 and the charging electrodes 60 belonging to the second electrode group E2 are disposed adjacent to each other.

Regarding applied voltages that are applied by the first power source 30 and the second power source 40, from the viewpoint of improving the chargeability of the spinning solution L to improve the drawing efficiency, an absolute value of a potential difference applied between the nozzle 21 and the collecting electrode 51 or between the nozzle 21 and the charging electrode 60 is preferably 1 kV or higher and more preferably 10 kV or higher.

In addition, from the viewpoint of preventing discharge between the nozzle 21 and each of the electrodes 51 and 60, the absolute value is preferably 100 kV or lower and more preferably 50 kV.

By applying the voltage such that the potential difference is in the above-described range, the chargeability of the spinning solution L is improved to improve the drawing efficiency, and discharge between the nozzle 21 and each of the electrodes 51 and 60 can be prevented.

In particular, from the viewpoint of improving the drawing efficiency of the spinning solution to efficiently form ultrafine fibers and obtaining a fiber sheet having a more uniform basis weight distribution, it is preferable that an output of each of the power sources 30 and 40 is set such that a difference between an absolute value of a voltage applied to the nozzles 21 belonging to the first nozzle group 21A and an absolute value of a voltage applied to the nozzles 21 belonging to the second nozzle group 21B is preferably ±40 kV or less, more preferably ±10 kV or less, and still more preferably zero.

From the same viewpoint, it is preferable that an output of each of the power sources 30 and 40 is set such that a difference between an absolute value of a voltage applied to the collecting electrodes 51 or the charging electrodes 60 belonging to the first electrode group E1 and an absolute value of a voltage applied to the collecting electrodes 51 or the charging electrodes 60 belonging to the second electrode group E2 is preferably 40 kV or less, more preferably 10 kV or less, and still more preferably zero.

The distance between the nozzles 21 adjacent to each other in the spinning units is preferably 10 mm or more and more preferably 20 mm or more.

In addition, the distance between the nozzles 21 adjacent to each other is preferably 200 mm or less and more preferably 150 mm or less.

By adjusting the distance between the nozzles 21 adjacent to each other to be in the above-described range, the spinning solutions that are discharged from the nozzles 21 and are charged to have different polarities can be prevented from coming into excessive contact with each other by electrical attraction, and unintended discharge between the nozzle 21 and each of the electrodes 51 and 60 can be prevented. In addition, a fiber sheet including ultrafine fibers can be obtained in a state where a basis weight distribution is uniform.

Distances D1 (refer to FIG. 2(*b*), FIG. 3(*b*), and FIG. 4(*b*)) from the tip ends of the nozzles 21 to the collecting portion 50 are each independently preferably 50 mm or more and more preferably 100 mm or more.

In addition, the distances D1 (refer to FIG. 2(*b*), FIG. 3(*b*), and FIG. 4(*b*)) from the tip ends of the nozzles 21 to the collecting portion 50 are each independently preferably 2 000 mm or less and more preferably 600 mm or less.

From the viewpoints of forming fibers having a smaller fiber diameter and obtaining a fiber sheet having a more uniform basis weight distribution, it is preferable that the nozzles 21 are disposed such that a difference between the distances D1 from the tip ends of the nozzles 21 to the collecting portion 50 is preferably ±100 mm or less, more preferably ±50 mm or less, and still more preferably zero.

In the aspect (A), when a fiber sheet having at least two peaks of fiber diameter distributions is produced, in the electrospinning device 10 illustrated in FIGS. 2(*a*) and 2(*b*), it is preferable that the fibers are electrospun such that at least either of diameters of nozzles 21, amounts of spinning solutions discharged, or applied voltages are different.

The applied voltages in the electrospinning device 10 illustrated in FIGS. 2(*a*) and 2(*b*) refer to the voltage applied to the nozzles 21 belonging to the first nozzle group 21A and the voltage applied to the nozzles 21 belonging to the second nozzle group 21B.

In addition, for the production of the fiber sheet having at least two peaks of fiber diameter distributions, when the electrospinning device 10 illustrated in FIGS. 3(*a*) and 3(*b*) is used, it is preferable that the fibers are electrospun such that at least either of diameters of nozzles 21, amounts of spinning solutions discharged, or voltages applied to the nozzles 21 are different.

The applied voltages in the electrospinning device 10 illustrated in FIGS. 3(*a*) and 3(*b*) refer to the voltage applied to the collecting electrodes 51 belonging to the first electrode group E1 and the voltage applied to the collecting electrodes 51 belonging to the second electrode group E2.

For the production of the fiber sheet having at least two peaks of fiber diameter distributions, when the electrospinning device 10 illustrated in FIGS. 4(*a*) and 4(*b*) is used, it is preferable that the fibers are electrospun such that at least either of diameters of nozzles 21, amounts of spinning solutions discharged, or voltages applied to the nozzles 21 are different.

The applied voltages in the electrospinning device 10 illustrated in FIGS. 4(*a*) and 4(*b*) refer to the voltage applied to the charging electrodes 60 belonging to the first electrode group E1 and the voltage applied to the charging electrodes 60 belonging to the second electrode group E2.

Even when the electrospinning device 10 adopts any of the above-described configurations, the fiber sheet having at least two peaks of fiber diameter distributions can be obtained in a state where the basis weight unevenness is not present and the distributions of the fibers are uniform.

In general, when the diameter of the nozzle is changed to increase, the amount of the spinning solution discharged increases. Therefore, the fiber diameter of the obtained fibers increases. On the other hand, under the same conditions, when the diameter of the nozzle is changed to decrease, the fiber diameter of the obtained fibers decreases.

In addition, when the amount of the spinning solution discharged increases, the fiber diameter of the obtained fibers increases. On the other hand, when the amount of the spinning solution discharged decreases, the fiber diameter of the obtained fibers decreases.

Further, when the applied voltage is high, the fiber diameter of the obtained fibers decreases. On the other hand, when the applied voltage is low, the fiber diameter of the obtained fibers increases.

This way, by appropriately changing at least either of diameters of nozzles, amounts of spinning solutions discharged, or applied voltages, a fiber sheet including plural kinds of long fibers that are controlled such that fiber diameter distribution peaks are observed in desired ranges is formed with high productivity.

In addition, by configuring fiber diameters to be different irrespective of whether the compositions of the fibers are the same or different, a fiber sheet including plural different kinds of fibers can be easily formed.

It is preferable that the diameter of the nozzle and the applied voltage are adjusted to be in the above-described ranges.

The amount of the spinning solution discharged from the nozzle 21 depends on conditions such as the diameter of the nozzle 21 or the fluidity of the spinning solution and is preferably 0.1 g/min or more, more preferably 0.3 g/min or more, and even more preferably 0.5 g/min or more.

In addition, the amount of the spinning solution discharged from the nozzle 21 is preferably 50 g/min or less, more preferably 30 g/min or less, and even more preferably 20 g/min or less.

When the fiber sheet according to the aspect (A) is produced to include the same kind of fibers, in the electrospinning device 10 illustrated in FIGS. 2(*a*) and 2(*b*), it is preferable that the fibers are electrospun such that the composition of the spinning solution discharged from the nozzles belonging to the first nozzle group 21A and the composition of the spinning solution discharged from the nozzles belonging to the second nozzle group 21B are the same.

In addition, for the production of the fiber sheet including the same kind of fibers, when the electrospinning device 10 illustrated in FIGS. 3(*a*) and 3(*b*) is used, it is preferable that the fibers are electrospun such that the composition of the spinning solution discharged from the nozzles 21 facing the collecting electrodes 51 belonging to the first electrode group E1 and the composition of the spinning solution discharged from the nozzles 21 facing the collecting electrodes 51 belonging to the second electrode group E2 are the same.

For the production of the fiber sheet including the same kind of fibers, when the electrospinning device 10 illustrated in FIGS. 4(*a*) and 4(*b*) is used, it is preferable that the fibers are electrospun such that the composition of the spinning solution discharged from the nozzles 21 in the spinning units that include the charging electrodes 60 belonging to the first electrode group E1 and the composition of the spinning solution discharged from the nozzles 21 in the spinning units that include the charging electrodes 60 belonging to the second electrode group E2 are the same.

In the electrospinning device 10, even when any of the configurations is adopted, a fiber sheet where fibers having different fiber diameters are mixed can be obtained in a state where the basis weight unevenness is not present.

In addition, when the fiber sheet according to any one of the aspects (A) and (B) is produced to include different kinds of fibers, in the electrospinning device 10 illustrated in FIGS. 2(*a*) and 2(*b*), it is preferable that the fibers are electrospun such that the composition of the spinning solution discharged from the nozzles belonging to the first nozzle group 21A and the composition of the spinning solution discharged from the nozzles belonging to the second nozzle group 21B are different.

In addition, for the production of the fiber sheet including different kinds of fibers, when the electrospinning device 10 illustrated in FIGS. 3(*a*) and 3(*b*) is used, it is preferable that the fibers are electrospun such that the composition of the spinning solution discharged from the nozzles 21 facing the collecting electrodes 51 belonging to the first electrode group E1 and the composition of the spinning solution discharged from the nozzles 21 facing the collecting electrodes 51 belonging to the second electrode group E2 are different.

For the production of the fiber sheet including different kinds of fibers, when the electrospinning device 10 illustrated in FIGS. 4(*a*) and 4(*b*) is used, it is preferable that the fibers are electrospun such that the composition of the spinning solution discharged from the nozzles 21 in the spinning units that include the charging electrodes 60 belonging to the first electrode group E1 and the composition of the spinning solution discharged from the nozzles 21 in the spinning units that include the charging electrodes 60 belonging to the second electrode group E2 are different.

Even when the electrospinning device 10 adopts any of the above-described configurations, the fiber sheet where fibers having different physical properties are mixed can be obtained in a state where the basis weight unevenness is not present and the distributions of the fibers are uniform.

The composition of the spinning solution refers to the kind and content of the resin in the spinning solution and the kind and content of the additive in the spinning solution.

In the aspect (A), specific examples of the composition of the spinning solution used for manufacturing the fiber sheet including the same kind of fibers include a spinning solution where the kinds of the resins and the kinds of the additives are the same and the contents of each of the components are the same.

In addition, in the aspects (A) and (B), specific examples of the composition of the spinning solution used for manufacturing the fiber sheet including different kinds of fibers include: (a) an aspect where the resin in one spinning solution and the resin in another resin are the same but the additive in the one spinning solution and the additive in the other resin are different; (b) an aspect where the resin in one spinning solution and the resin in another resin are different but the additive in the one spinning solution and the additive in the other resin are the same; (c) an aspect where the resin in one spinning solution and the resin in another resin are different and the additive in the one spinning solution and the additive in the other resin are the same; (d) an aspect where the kinds of the resins and the kinds of the additives in the both spinning solutions are the same but the contents thereof in the spinning solutions are different; and (e) an aspect where the contents of at least either of the resins or the additives in (a) to (c) are different.

When a gas flow is jetted from the gas flow jetting portion 80 to produce fibers, from the viewpoint of maintaining a state where the spatial temperature around the nozzle 21 in the discharge direction of the spinning solution is higher and improving the drawing efficiency of the spinning solution to produce fibers having a smaller fiber diameter, it is preferable that a gas flow having a higher temperature than a solidification temperature of the resin to be used is jetted from the gas flow jetting portion 80.

The solidification temperature of the resin refers to the melting point of the resin used as a material for producing the fiber sheet.

It is advantageous to jet the heated gas flow to produce fibers in that, when molten resin is used as the spinning solution, the drawing efficiency can be further improved and fibers having a smaller fiber diameter can be efficiently produced.

The temperature of the heated gas flow can be appropriately changed depending on the kind of the raw resin and the melting point thereof. The temperature of the gas flow is preferably 100° C. or higher and more preferably 150° C. or higher and is preferably 500° C. or lower and more preferably 400° C. or lower.

The flow rate of the gas flow of the gas flow jetting portion 80 is preferably 40 L/min or more and more preferably 80 L/min or more and is preferably 500 L/min or less and more preferably 400 L/min or less.

The wind speed of the gas flow of the gas flow jetting portion 80 is preferably 1 m/min or more and more preferably 2 m/min or more and is preferably 300 m/min or less and more preferably 200 m/min or less.

The temperature, the flow rate, and the wind speed of the gas flow are values at a terminal of each of the gas flow jetting portions 80.

The temperature, the flow rate, and the wind speed of the gas flow can be appropriately adjusted, for example, by changing each of the degree of heating and the degree of supply in a gas flow supply source.

In general, when the temperature of the gas flow to be blown is changed to increase, the molten state of the resin is maintained, and the molten resin is likely to be drawn. Therefore, the fiber diameter of the obtained fibers decreases. On the other hand, when the temperature of the gas flow to be blown is changed to decrease, fiber diameter of the obtained fibers increases.

In addition, when at least either of the flow rate or the wind speed of the gas flow to be blown is changed to increase, the molten resin is likely to be drawn by an external force generated by the gas flow. Therefore, the fiber diameter of the obtained fibers decreases. On the other hand, when at least either of the flow rate or the wind speed of the gas flow to be blown is changed to decrease, the fiber diameter of the obtained fibers increases.

In addition, by configuring fiber diameters to be different irrespective of whether the compositions of the fibers are the same or different, a fiber sheet including plural different kinds of fibers can be easily formed.

When a gas flow is jetted from the gas flow jetting portion 80 to produce fibers, in the electrospinning device 10 illustrated in FIGS. 2(*a*) and 2(*b*), it is preferable that the fibers are electrospun such that at least either of the flow rates or the wind speeds of the gas flows jetted from the gas flow jetting portions 80 are different.

In the electrospinning device 10 illustrated in FIGS. 2(*a*) and 2(*b*), in order to allow at least either of the flow rates or the wind speeds of the gas flows jetted from the gas flow jetting portions 80 to be different, at least either of the flow rates or the wind speeds of the gas flows jetted from a first gas flow jetting portion that is disposed in the spinning units 20 including the nozzles 21 belonging to the first nozzle group 21A and a second gas flow jetting portion that is disposed in the spinning units 20 including the nozzles 21 belonging to the second nozzle group 21B may be made to be different.

As a result, a fiber sheet including a plurality of fiber groups can be produced.

In addition, for the production of the fiber sheet by allowing at least either of the flow rates or the wind speeds of the gas flows jetted from the gas flow jetting portions 80 to be different, when the electrospinning device 10 illustrated in FIGS. 3(*a*) and 3(*b*) and the electrospinning device 10 illustrated in FIGS. 4(*a*) and 4(*b*) are used, it is preferable that the fibers are electrospun such that at least either of the flow rates or the wind speeds of the gas flows jetted from the first gas flow jetting portion that is disposed in the spinning units 20 including the collecting electrodes 51 or the charging electrodes 60 belonging to the first electrode group E1 and the second gas flow jetting portion that is disposed in the spinning units 20 including the collecting electrodes 51 or the charging electrodes 60 belonging to the second electrode group E2 are different.

When the fiber sheet according to the aspect (C) is produced, voltages are applied such that, for example, in a state where the diameters of the nozzles, the amounts of the spinning solutions discharged, and the compositions of the spinning solutions and preferably the flow rates and wind speeds of the gas flows are the same in the spinning units, polarities of voltages applied to the nozzles 21 belonging to the nozzle groups 21A and 21B are different or polarities of voltages applied to the collecting electrodes 51 or the charging electrodes 60 belonging to the electrode groups E1 and E2 are different. At this time, the absolute values of the applied voltages are the same in the nozzle groups 21A and 21B or in the electrode groups E1 and E2.

As a result, the fiber sheet including only one kind of long fibers can be obtained in a state where the basis weight distribution is uniform, and the fiber diameter of the constituent fibers decreases.

As clearly seen from the above explanation, the present disclosure also includes the fiber sheet that is produced using the above-described production method. In the fiber sheet that is produced using the above-described production method, the fibers spun from the spinning units are preferably uniformly present in the sheet in a mixed state. Even when the constituent components or the fiber diameters of the spun fibers are different, different kinds of fibers are not unevenly distributed, and the distributions of the constituent fibers in the sheet or the basis weight distribution of the sheet itself can be made to be uniform. As a result, for example, one or two or of the effects such as the effect of increasing the strength of the sheet or the effect of exhibiting two or more desired characteristics derived from the components of the constituent fibers with one sheet can be exhibited.

In addition, as described above, in the fiber sheet obtained using the production method according to the present disclosure, the constituent fibers are preferably uniformly present in the sheet in a mixed state. However, for example, as in a general method of producing spunbond-meltblown-spunbond nonwoven fabric, when a plurality of nozzles is disposed in a row in a conveyance direction, fibers spun from the nozzles are stacked in a layer shape. As a result, it is difficult to obtain the fiber sheet in the state where the fibers are mixed having the suitable configuration for the present disclosure.

When a molten resin is used in a melting method, a method of producing the molten resin is not particularly limited. For example, the molten resin can be produced by heating and melting thermoplastic resin, optionally adding the above-described additive to the molten thermoplastic resin, and heating the components to knead the components.

The molten resin may be produced by using a heated and melted resin as a master batch or may be produced by supplying the thermoplastic resin and optionally the additive to the spinning solution supply portion during manufacturing and heating, melting, and kneading the components in the spinning solution supply portion.

The molten resin may include an additive other than a charge control agent within a range where the effects of the present invention do not deteriorate.

Examples of the additive include an antioxidant, a neutralizer, a light stabilizer, an ultraviolet absorber, a lubricant, an antistatic agent, a metal deactivator, and a hydrophilizing agent.

Examples of the antioxidant include a phenol-based antioxidant, a phosphite-based antioxidant, and a thio-based antioxidant.

Examples of the neutralizer include higher fatty acid salts such as calcium stearate or zinc stearate.

Examples of the light stabilizer and the ultraviolet absorber include hindered amines, nickel complex compounds, benzotriazoles, and benzophenones.

Examples of the lubricant include higher fatty acid amides such as stearic acid amide. Examples of the antistatic agent include fatty acid partial esters such as glycerin fatty acid monoester.

Examples of the metal deactivator include phosphonate, epoxy, triazole, hydrazide, and oxamide.

Examples of the hydrophilizing agent include a nonionic surfactant such as a polyvalent alcohol fatty acid ester, an ethylene oxide adduct, and an amine amide.

When the thickness of the fibers produced through the above-described steps is expressed by circle equivalent diameter, ultrafine fibers called nanofibers having a fiber diameter of 50 μm or less are obtained. The fiber diameter of the nanofibers is preferably 10 nm or more and more preferably 0.1 μm or more.

In addition, the fiber diameter of the nanofibers is preferably 30 μm or less and more preferably 10 μm or less.

A peak of a fiber diameter distribution of the nanofibers is preferably 3 μm or less and more preferably 1 μm or less and is preferably 0.01 μm or more and more preferably 0.05 μm or more. The nanofibers are typically the above-described first fibers.

In addition, when the second fibers having a larger fiber diameter than the first fibers are included as in the aspect (A), a peak of a fiber diameter distribution of the fibers is preferably 200 μm or less and more preferably 100 μm or less and is preferably more than 3 μm and more preferably 5 μm or more.

The fibers produced using the electrospinning device according to the present invention can be used for various purposes as a fiber molded body obtained by depositing the fibers.

Examples of the shape of the molded body include the above-described fiber sheet, a flocculent body, a filamentous body. The fiber molded body may be used in a state where it is stacked on another sheet, is cut in a desired dimensions, or include various liquids, fine particles, or fibers.

For example, the fiber sheet is suitably used as nonwoven fabric that is attached to a skin, tooth, gum, or hair of a person, a skin, tooth, or gum of a non-human mammalian, a plant surface such as a branch or a leaf, an article surface, or the like for medical use or for non-medical use such as cosmetic use, decorative use, or cleaning use.

In addition, the fiber sheet is also suitably used as a high-efficiency filter with high dust collecting properties and low pressure loss, a battery separator usable at a high current density, or a cell culturing substrate having a high-porosity structure. The flocculent body of melt electrospun fibers is suitably used as a soundproof material, a heat insulating material, or the like.

In addition to the above-described uses, the fiber sheet can also be used as an electromagnetic shield material, a bioartificial device, an IC chip, an organic EL, a solar cell, an electrochromic display element, a photoelectric conversion element, or the like.

Hereinabove, the present invention has been described based on the preferable embodiments, but the present invention is not limited to the embodiments.

For example, each of the embodiments of the electrospinning device 10 has been described as the aspect where one nozzle 21 is disposed in one spinning unit 20. However, as long as the effects of the present invention are exhibited, two or more nozzles 21 may be disposed in one spinning unit 20.

In addition, in the above description, one discharge port of the nozzle 21 from which the spinning solution is discharged is disposed at the tip end of one nozzle 21. However, a plurality of discharge ports may be provided for one nozzle 21.

In either case, there is an advantageous effect in that the amount of the spinning solution discharged can be increased to improve the production efficiency of the fiber sheet.

EXAMPLES

Hereinafter, the present invention will be further described in detail using Examples. However, the range of the present invention is not limited to the Examples.

Comparative Example 1

Using the electrospinning device 10 having the structure illustrated in FIGS. 4(*a*) and 4(*b*) except for the polarities of the voltages, a spinning solution L of a molten resin formed of a resin composition was spun with a melt electrospinning method to produce an long strip-shaped fiber sheet formed of fibers, the resin composition including: 95 mass % of polypropylene (PP; manufactured by PolyMirae, MF650Y, melting point: 160° C.) as a resin that is a raw material; and 5 mass % of an acylalkyltaurine salt (sodium N-stearoyl-N-methyltaurate; manufactured by Nikko Chemicals Co., Ltd., NIKKOL SMT) as an additive.

This electrospinning device 10 includes four spinning units 20 including the nozzle 21 and the charging electrode 60, in which the spinning units 20 are disposed in a row in the perpendicular direction CD such that the distance between the adjacent nozzles 21 in the perpendicular direction CD is 100 mm. Spinning conditions of the melt electrospinning method are as described below, and polarities of voltages applied to the adjacent charging electrodes 60 are the same.

- Production environment: 27° C., 50% RH
- Heating temperature of spinning solution L: 200° C.
- Amount of spinning solution L discharged: 2 g/min
- Inner diameter of nozzle 21: 0.25 mm
- Applied voltage to each of nozzles 21 (formed of stainless steel): 0 kV (grounded)
- Applied voltage to each of charging electrodes 60: −20 kV
- Temperature of gas flow jetted from gas flow jetting portion 80: 300° C.
- Flow rate of gas flow jetted from gas flow jetting portion 80: 100 L/min
- Distance between tip end of nozzle 21 and collecting portion 50: 550 mm
- Conveyance speed of collecting portion 50 in MD direction: 1.5 m/min The obtained long strip-shaped fiber sheet (length in the perpendicular direction CD: 400 mm) was picked up and was cut in a rectangular shape having a length of 400 mm in a direction along the perpendicular direction CD and having a length of 60 mm in a direction along the conveyance direction MD. This fiber sheet was divided into 20 pieces in the CD direction, and divided sheets that were further cut into a length of 60 mm and a width of 20 mm were prepared. These divided sheets were further shredded into 20 square mm to prepare shredded sheets. By dividing the mass (g) of each of the shredded sheets by the area of the shredded sheet (4 000 $mm^2$=0.004 $mm^2$), the basis weight (g/$m^2$) of each of the fiber sheets based on the position in the CD direction was calculated as an arithmetic mean value of N=3. A basis weight distribution of the fiber sheet in the CD direction was plotted on a graph where one end of the fiber sheet in the CD direction was set as 0 mm and another end of the fiber sheet in the CD direction was set as 400 mm. The results are illustrated in FIG. 6(*a*).

Example 1

In the electrospinning device 10 having the structure illustrated in FIGS. 4(*a*) and 4(*b*) and having the configuration described in Comparative Example 1, the first power source 30 and the second power source 40 were connected and applied voltages such that polarities of the electrodes applied to the charging electrodes 60 in the spinning units 20 adjacent to each other were different. That is, a negative voltage (−20 kV) was applied from the first power source 30 connected to the first electrode group E1, and a positive voltage (+20 kV) was applied from the second power source 40 connected to the second electrode group E2. Other spinning conditions of the melt electrospinning method were set to be the same as described above in Comparative Example 1, and a long strip-shaped fiber sheet (length in the perpendicular direction CD: 400 mm) was produced. The basis weight distribution of the obtained fiber sheet in the CD direction was calculated using the same method as that of Comparative Example 1 and was plotted on the graph. The results are illustrated in FIG. 6(*b*).

Figure 6A:
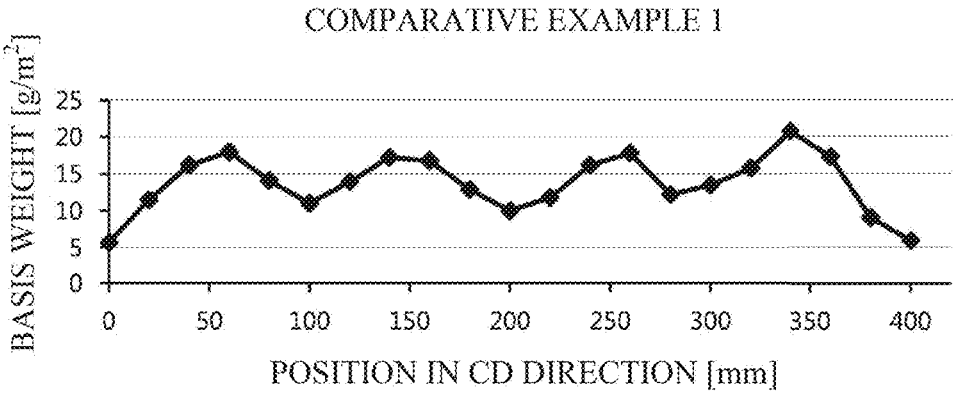
FIG. 6(*a*) is a graph illustrating a basis weight distribution in a width direction of a fiber sheet according to Comparative Example 1, and FIG. 6(*b*) is a graph illustrating a basis weight distribution in a width direction of a fiber sheet according to Example 1.
Figure 6B:
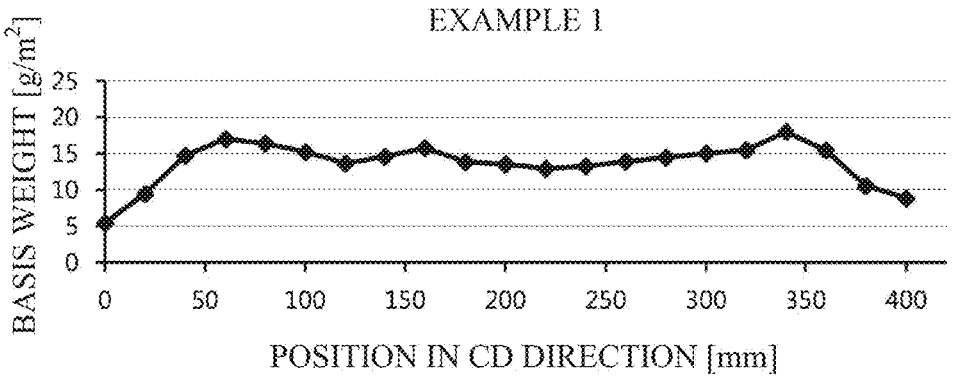

As illustrated in FIGS. 6(*a*) and 6(*b*), when the basis weight distributions of the fiber sheets produced in Example and Comparative Example in the CD direction were compared to each other, the basis weight distribution of Example 1 in the CD direction was about 13 to 18 g/m$^2$ in a range of the width in the CD direction of 50 mm to 350 mm, and a variation in basis weight was small. On the other hand, the basis weight distribution of Comparative Example 1 in the CD direction was about 10 to 20 g/m$^2$ in a range of the width in the CD direction of 50 mm to 350 mm, and a variation in basis weight in the CD direction was larger than that of Example 1. It can be seen that by applying the voltages to the electrodes or the nozzles such that polarities of the voltages are different as described above, a fiber sheet having a small variation in basis weight particularly in the width direction of the fiber sheet, that is having a uniform basis weight distribution can be produced with high productivity.

Example 2

Using the electrospinning device 10 having the structure illustrated in FIGS. 4(*a*) and 4(*b*), a spinning solution L of a molten resin having the same composition as that of Comparative Example 1 was spun with a melt electrospinning method to produce a long strip-shaped fiber sheet formed of fibers.

This electrospinning device 10 includes two spinning units 20 including the nozzle 21 and the charging electrode 60, in which the spinning units 20 are disposed in a row in the perpendicular direction CD such that the distance between the adjacent nozzles 21 in the perpendicular direction CD is 100 mm. Polarities of the voltages applied to the adjacent charging electrodes 60 were different.

In this example, the amounts of the spinning solutions discharged, the temperatures, the flow rates, and the wind speeds of the gas flows, and the applied voltages were adjusted to be different in one spinning unit 20 and another spinning unit 20. Other spinning conditions were the same as those of Example 1. The following spinning conditions are shown as "Condition of One Spinning Unit 20/Condition of Another Spinning Unit 20".

Figure 7:
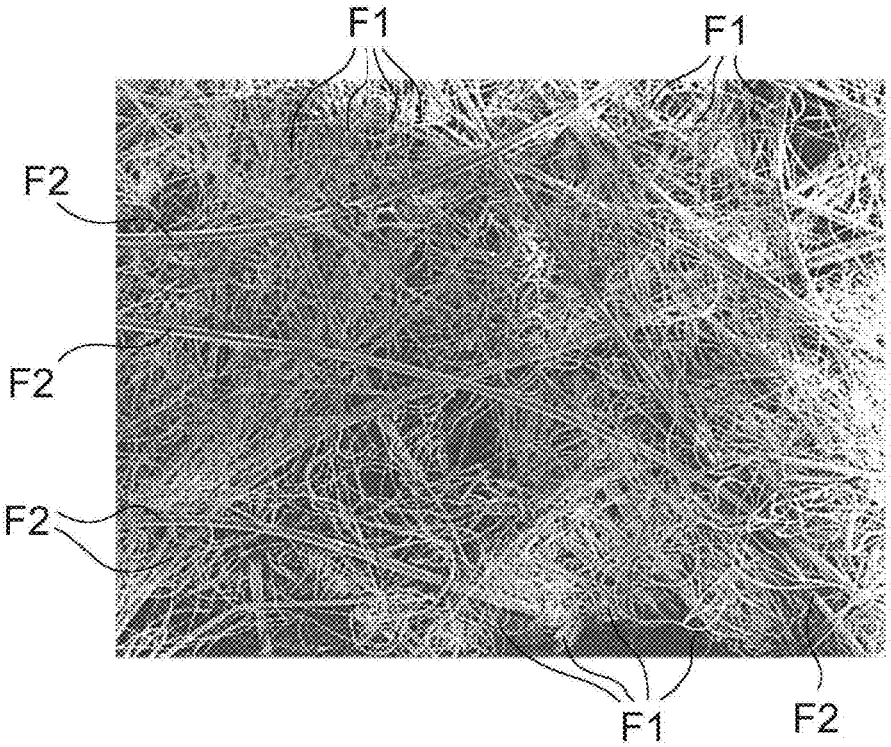
FIG. 7 is a scanning electron microscope image at 50-fold magnification illustrating a state where constituent fibers of a first fiber group and constituent fibers of a second fiber group are present in a fiber sheet according to Example 2.

- Amount of spinning solution L discharged: 1 g/min/2 g/min
- Temperature of gas flow jetted from gas flow jetting portion 80: 350° C./250° C.
- Flow rate of gas flow jetted from gas flow jetting portion 80: 320 L/min/200 L/min
- Wind speed of gas flow jetted from gas flow jetting portion 80: 50 m/min/23 m/min
- Applied voltage to each of charging electrodes 60: −20 kV/+5 kV As a result, the fiber sheet obtained in Example 2 was formed of long fibers as illustrated in FIG. 7. In FIG. 7, constituent fibers of the first fiber group are represented by reference numeral F1, and constituent fibers of the second fiber group are represented by reference numeral F2.

Figure 8:
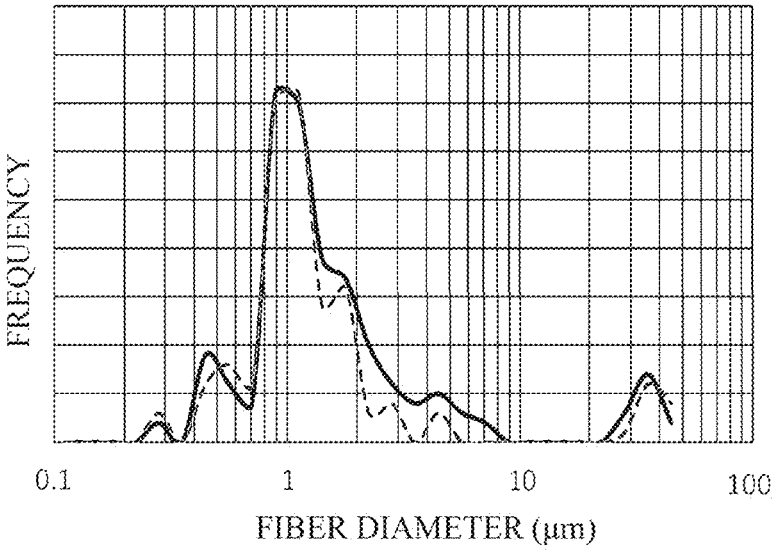
FIG. 8 is a histogram illustrating a fiber diameter distribution regarding the fiber sheet according to Example 2.

FIG. 8 illustrates a histogram (in the same diagram, indicated by a solid line) measured and generated based on one surface of the fiber sheet obtained in Example 2 and a histogram (in the same diagram, indicated by a dotted line) measured and generated based on another surface of the fiber sheet obtained in Example 2.

In the histogram of the one surface of the fiber sheet obtained in Example 2, a peak position of a fiber diameter distribution of a fiber diameter of 3 μm or less was 0.89 μm, a peak position of a fiber diameter distribution peak of a fiber diameter of more than 3 was 35.5 μm, and a plurality of fibers having different fiber diameters were mixed.

Likewise, in the histogram of the other surface of the fiber sheet obtained in Example 2, a peak position of a fiber diameter distribution of a fiber diameter of 3 μm or less was 1.12 μm, a peak position of a fiber diameter distribution peak of a fiber diameter of more than 3 μm was 35.5 μm, and a plurality of fibers having different fiber diameters were mixed.

In addition, the ratio P2 of a frequency of the number of fibers at a highest peak in a range of a fiber diameter of 3 μm or less to a frequency of the number of fibers at a highest peak in a range of a fiber diameter of more than 3 μm was 5.1 on the one surface of the fiber sheet and was 6.0 on the other surface of the fiber sheet.

In the fiber sheet according to Example 2, the arithmetic mean value La of P2 on the one surface and the other surface of the fiber sheet was calculated as 5.6. In addition, the degree of the variation of the ratio P2 was calculated as ±7.7% from the calculation expression 100×(Ratio P2−Arithmetic Mean Value La)/Arithmetic Mean Value La (%), and the distribution unevenness of the fibers was small.

In addition, in the fiber sheet obtained in Example 2, the impedance ratio AB of the fine long fibers in the first fiber group was $2.1\times10^2$, and the proportion of the number of the long fibers in the fiber sheet was 70% or more.

In each of the fiber sheets according to Examples and Comparative Examples, the number of fused portions between fibers, and the ratio P2 of a frequency of the number of fibers at a highest peak in a range of a fiber diameter of 3 μm or less to a frequency of the number of fibers at a highest peak in a range of a fiber diameter of more than 3 μm at a position of fiber diameter where a peak of the histogram was shown were measured using the above-described method. The results are shown in Tables 1 and 2 below.

As shown in Tables 1 and 2, it can be seen that, in each of the sheets according to Examples, the number of fused portions between the fibers was small, and the fibers were present in a mixed and uniform state.

TABLE 1

| | Example 1 | Comparative Example 1 |
|---|---|---|
| Aspect of Fiber Sheet | Aspect (C) | Aspect (C) |
| Number of Fused portions | 4 | 5 |
| Average Basis Weight in Range of Position in CD Direction of 50 to 350 mm | 14.9 | 15.0 |
| Standard Deviation in Range of Position in CD Direction of 50 to 350 mm | 1.33 | 2.82 |
| Electric impedance A/B of Entire Fiber Sheet Constituent Resin represented by Expression (X) | $2.1\times10^2$ | $2.1\times10^2$ |

TABLE 2

| | | Example 2 Aspect (A) | |
|---|---|---|---|
| | | Peak at 3 μm or less | Peak at more than 3 μm |
| One Surface Side | Fiber diameter [μm] where Highest Peak Position is Shown | 0.89 | 35.5 |
| | Number of Fused portions | 3 | |
| | Ratio P2 (P2a) of Frequency of Number of Fibers at Highest Peak in Range of Fiber Diameter of 3 μm or less to Frequency of Number of Fibers at Highest Peak in Range of Fiber Diameter of more than 3 μm | 5.1 | |
| Another Surface Side | Fiber diameter [μm] where Highest Peak Position is Shown | 1.12 | 35.5 |
| | Number of Fused portions | 3 | |
| | Ratio P2 (P2a) of Frequency of Number of Fibers at Highest Peak in Range of Fiber Diameter of 3 μm or less to Frequency of Number of Fibers at Highest Peak in Range of Fiber Diameter of more than 3 μm | 6.0 | |
| P2a/P2b | | 0.9 | |
| Electric impedance A/B of Entire Fiber Sheet Constituent Resin represented by Expression (X) | | $2.1 \times 10^2$ | |
| Mixed State of Fibers | Arithmetic Mean Value La of P2a and P2b | 5.6 | |
| | Degree of Variation: $100 \times (P2 - La)/La$ | 7.7% | |

INDUSTRIAL APPLICABILITY

According to the present invention, a fiber sheet having a uniform basis weight distribution can be produced.

In addition, according to the present invention, a fiber sheet including plural kinds of fibers in a mixed state is provided.

The invention claimed is:

1. An electrospinning device comprising:

a plurality of nozzles to discharge a spinning solution including a resin;

a plurality of power sources to apply charges to the spinning solution; and a plurality of electrodes, distant from the plurality of nozzles, to generate an electric field between the plurality of nozzles, wherein the plurality of power sources apply different charges to the spinning solution discharged from the plurality of nozzles, respectively, the plurality of nozzles include one or more nozzles belonging to a first nozzle group and one or more nozzles belonging to a second nozzle group different from the first nozzle group, the one or more nozzles that belong to the first nozzle group and the one or more nozzles that belong to the second nozzle group are adjacent to each other, the plurality of electrodes includes one or more electrodes belonging to a first electrode group and one or more electrodes belonging to a second electrode group different from the first electrode group, and the different charges are applied to the spinning solution such that a first polarity of a first voltage applied to the one or more electrodes belonging to the first electrode group and a second polarity of a second voltage applied to the one or more electrodes belonging to the second electrode group are different from each other.

2. The electrospinning device according to claim 1, wherein the different charges are applied to the spinning solution such that a first polarity of a third voltage applied to the one or more nozzles belonging to the first nozzle group and a second polarity of a fourth voltage applied to the one or more nozzles belonging to the second nozzle group are different from each other.

3. The electrospinning device according to claim 2, wherein the third voltage is different in value than the fourth voltage.

4. The electrospinning device according to claim 1, further comprising, as the plurality of electrodes, a plurality of collecting electrodes that face the plurality of nozzles, wherein the different charges are applied to the spinning solution such that the first polarity of the first voltage applied to the collecting electrode or electrodes belonging to the first electrode group and the second polarity of the second voltage applied to the collecting electrode or electrodes belonging to the second electrode group are different from each other.

5. The electrospinning device according to claim 1, further comprising, as the plurality of electrodes, a plurality of charging electrodes that surround the plurality of nozzles, wherein the different charges are applied to the spinning solution such that the first polarity of the first voltage applied to the charging electrode or electrodes belonging to the first electrode group and the second polarity of the second voltage applied to the charging electrode or electrodes belonging to the second electrode group are different from each other.

6. The electrospinning device according to claim 1, further comprising a gas flow jetting portion to jet a gas flow from a rear end of each of the plurality of nozzles toward a tip end of the plurality of nozzles in a same direction in which the plurality of nozzles extends.

7. The electrospinning device according to claim 1, wherein the one or more nozzles that belong to the first nozzle group comprise two of more of the plurality of nozzles, and the one or more nozzles that belong to the second nozzle group comprise two or more of the plurality of nozzles.

8. The electrospinning device according to claim 1, wherein the plurality of nozzles of the first nozzle group and the plurality of nozzles of the second nozzle group are arranged rows of the nozzles.

9. The electrospinning device according to claim 8, wherein a first row of the rows of nozzles is electrically connected to a first power source of the plurality of the power sources associated with a first charge of the different charges and a second row of the rows of nozzles is electrically connected to a second power source of the plurality of the power sources associated with a second charge of the different charges.

10. The electrospinning device according to claim 8, wherein each of the rows of nozzles are electrically connected to both a first power source of the plurality of the power sources associated with a first charge of the different charges and a second power source of the plurality of the power sources associated with a second charge of the different charges, each of the nozzles of the rows of nozzles being alternatingly connected to the first power source and the second power source.

11. A system for electrospinning a fiber sheet comprising:

a collecting medium on which the fiber sheet is deposited;

a plurality of nozzles to discharge a spinning solution including a resin, the nozzles facing the collecting medium;

a plurality of power sources to apply charges to the spinning solution; and a plurality of electrodes, distant from the plurality of nozzles, to generate an electric field between the plurality of nozzles, wherein the plurality of power sources applies different voltages associated with the different charges to the spinning solution discharged from the plurality of nozzles, respectively, the plurality of nozzles include one or more nozzles belonging to a first nozzle group and one or more nozzles belonging to a second nozzle group different from the first nozzle group, the one or more nozzles that belong to the first nozzle group and the one or more nozzles that belong to the second nozzle group are adjacent to each other, the plurality of electrodes includes one or more electrodes belonging to a first electrode group and one or more electrodes belonging to a second electrode group different from the first electrode group, and the different voltages are applied to the spinning solution such that a first polarity of a first voltage applied to the one or more electrodes belonging to the first electrode group and a second polarity of a second voltage applied to the one or more electrodes belonging to the second electrode group are different from each other.

12. The electrospinning system according to claim 11, wherein the voltages are applied to the spinning solution such that a first polarity of a third voltage applied to the one or more nozzles belonging to the first nozzle group and a second polarity of a fourth voltage applied to the one or more nozzles belonging to the second nozzle group are different from each other.

13. The electrospinning system according to claim 12, wherein the third voltage is different in value than the fourth voltage.

14. The electrospinning system according to claim 13, further comprising, as the plurality of electrodes, a plurality of collecting electrodes disposed on the collecting medium that faces the plurality of nozzles, wherein the different voltages are applied to the spinning solution such that the first polarity of the first voltage applied to the collecting electrode or electrodes belonging to the first electrode group and the second polarity of the second voltage applied to the collecting electrode or electrodes belonging to the second electrode group are different from each other.

15. The electrospinning system according to claim 13, further comprising, as the plurality of electrodes, a plurality of charging electrodes that surround the plurality of nozzles, wherein the voltages are applied to the spinning solution such that the first polarity of the first voltage applied to the charging electrode or electrodes belonging to the first electrode group and the second polarity of the second voltage applied to the charging electrode or electrodes belonging to the second electrode group are different from each other.

16. The electrospinning system according to claim 11, further comprising a gas flow jetting portion to jet a gas flow from a rear end of each of the plurality of nozzles toward a tip end of the plurality of nozzles in a same direction in which the plurality of nozzles extends.

17. The electrospinning system according to claim 11, wherein the one or more nozzles that belong to the first nozzle group comprise two or more of the plurality of nozzles, and the one or more nozzles that belong to the second nozzle group comprise two or more of the plurality of nozzles.

18. The electrospinning system according to claim 11, wherein the plurality of nozzles of the first nozzle group and the plurality of nozzles of the second nozzle group are arranged in rows of the nozzles.

19. The electrospinning system according to claim 18, wherein a first row of the rows of nozzles is electrically connected to a first power source of the plurality of the power sources associated with a first charge of the different charges and a second row of the rows of nozzles is electrically connected to a second power source of the plurality of the power sources associated with a second charge of the different charges.

20. The electrospinning system according to claim 18, wherein each of the rows of nozzles are electrically connected to both a first power source of the plurality of the power sources associated with a first charge of the different charges and a second power source of the plurality of the power sources associated with a second charge of the different charges, each of the nozzles of the rows of nozzles being alternatingly connected to the first power source and the second power source.

* * * * *